US008824935B2

(12) United States Patent
Seki et al.

(10) Patent No.: US 8,824,935 B2
(45) Date of Patent: Sep. 2, 2014

(54) DEVELOPMENT DEVICE, PROCESS CARTRIDGE INCORPORATING SAME, AND IMAGE FORMING APPARATUS INCORPORATING SAME

(75) Inventors: Hideyasu Seki, Tokyo (JP); Yasuyuki Ishii, Tokyo (JP); Hideki Kosugi, Kanagawa (JP); Tetsuro Hirota, Kanagawa (JP); Masaaki Yamada, Tokyo (JP); Atsushi Kurokawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 196 days.

(21) Appl. No.: 13/225,905

(22) Filed: Sep. 6, 2011

(65) Prior Publication Data

US 2012/0063815 A1 Mar. 15, 2012

(30) Foreign Application Priority Data

Sep. 10, 2010 (JP) ..... 2010-203479

(51) Int. Cl.
*G03G 15/08* (2006.01)

(52) U.S. Cl.
USPC ..... 399/265; 399/266; 399/290; 399/291

(58) Field of Classification Search
USPC ..... 399/265, 266, 290, 291
See application file for complete search history.

(56) References Cited

U.S. PATENT DOCUMENTS 5,206,693 A * 4/1993 Folkins ..... 399/291
5,360,940 A * 11/1994 Hays ..... 399/266
5,517,287 A * 5/1996 Rodriguez et al. ..... 399/285
5,708,940 A * 1/1998 Hosaka et al. ..... 399/266
6,134,412 A * 10/2000 Thompson ..... 399/266
6,400,921 B1 * 6/2002 Leclerc et al. ..... 399/266
6,708,014 B2 * 3/2004 Miyaguchi et al. ..... 399/266
6,901,231 B1 * 5/2005 Sakai et al. ..... 399/266
6,901,232 B2 * 5/2005 Sakuma et al. ..... 399/266
7,062,204 B2 * 6/2006 Miyaguchi et al. ..... 399/252

(Continued)

FOREIGN PATENT DOCUMENTS

JP 2006-259190 9/2006
JP 2007-133388 5/2007

(Continued)

OTHER PUBLICATIONS

OA issued Feb. 18, 2014, in Japanese Patent Application No. 2010-203479.

*Primary Examiner* — David Bolduc
(74) *Attorney, Agent, or Firm* — Oblon, Spivak, McClelland, Maier & Neustadt, L.L.P.

(57) ABSTRACT

A development device includes a developer container; a rotary cylindrical developer carrier including an outer electrode including multiple electrode portions arranged in a circumferential direction of the developer carrier, an inner electrode provided on an inner circumferential side of the developer carrier from the outer electrode, an insulation layer disposed between the outer electrode and the inner electrode, and a surface layer; and a bias power source to apply a first bias voltage and a second bias voltage to the inner electrode and the outer electrode, respectively. The first bias power source causes an electrical potential difference that changes with time between the inner electrode and the outer electrode to cause the developer to hop on a circumferential surface of the developer carrier. At least one of the first bias voltage and the second bias voltage has a cyclic waveform in which pulse-on time is reduced.

19 Claims, 15 Drawing Sheets

(56) References Cited

U.S. PATENT DOCUMENTS

| | | | | |
|---|---|---|---|---|
| 7,783,235 | B2 | 8/2010 | Tsukamoto et al. | |
| 7,907,856 | B2 | 3/2011 | Tsukamoto et al. | |
| 2005/0158073 | A1* | 7/2005 | Nakazato et al. | 399/111 |
| 2006/0120765 | A1* | 6/2006 | Sakai et al. | 399/265 |
| 2006/0210320 | A1* | 9/2006 | Nakagawa et al. | 399/265 |
| 2007/0086811 | A1* | 4/2007 | Tsukamoto et al. | 399/265 |
| 2007/0242985 | A1* | 10/2007 | Aoki et al. | 399/274 |
| 2008/0089723 | A1 | 4/2008 | Tsukamoto et al. | |
| 2008/0286015 | A1 | 11/2008 | Kadota et al. | |
| 2009/0016781 | A1* | 1/2009 | Takahashi et al. | 399/266 |
| 2009/0022523 | A1 | 1/2009 | Kadota et al. | |
| 2009/0035025 | A1 | 2/2009 | Ishii et al. | |
| 2009/0067889 | A1* | 3/2009 | Nakagawa et al. | 399/266 |
| 2009/0257786 | A1* | 10/2009 | Nakagawa et al. | 399/265 |
| 2009/0290901 | A1* | 11/2009 | Ishii et al. | 399/103 |
| 2009/0297228 | A1* | 12/2009 | Maeda et al. | 399/266 |
| 2010/0028055 | A1* | 2/2010 | Lean et al. | 399/266 |
| 2010/0104313 | A1* | 4/2010 | Kosaka et al. | 399/88 |
| 2010/0150615 | A1 | 6/2010 | Nakagawa et al. | |
| 2010/0202794 | A1* | 8/2010 | Kosaka et al. | 399/88 |
| 2011/0064432 | A1 | 3/2011 | Horike et al. | |
| 2011/0164892 | A1 | 7/2011 | Ogawa et al. | |
| 2011/0182626 | A1* | 7/2011 | Hirota et al. | 399/266 |

FOREIGN PATENT DOCUMENTS

| | | | |
|---|---|---|---|
| JP | 2008-116599 | | 5/2008 |
| JP | 2008-122794 | | 5/2008 |
| JP | 2009-20214 | A | 1/2009 |
| JP | 2009-36929 | A | 2/2009 |
| JP | 2010-39344 | A | 2/2010 |
| JP | 2010-191209 | A | 9/2010 |

* cited by examiner

DEVELOPMENT DEVICE, PROCESS CARTRIDGE INCORPORATING SAME, AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2010-203479, filed on Sep. 10, 2010, in the Japan Patent Office, the entire disclosure of which is hereby incorporated herein by reference.

FIELD OF THE INVENTION

The present invention generally relates to a development device used in an image forming apparatus such as a copier, a printer, a facsimile machine, or a multifunction machine capable of at least two of these functions, a process cartridge incorporating the development device, and an image forming apparatus incorporating the development device.

BACKGROUND OF THE INVENTION

Development devices including a developer carrier provided with multiple electrodes to which different voltages are applied are known.

For example, there are development devices that supply toner to latent images formed on latent image bearers, such as photoreceptors, to develop the latent image without bringing the toner into direct contact with the latent image bearer. An example of such development methods is to supply toner to the latent image bearer by causing the toner to hop and form clouds (i.e., toner clouds) on or around the developer carrier. The developer carrier used in this method includes multiple different types of electrodes arranged alternately at a predetermined pitch in the circumferential direction of the developer carrier, and an outer circumferential side of the electrodes is covered with a protective layer. Separate voltages that change differently from each other with time are applied to the different types of electrodes, thus generating electrical fields that change differently from each other with time between adjacent electrodes. Then, the electrical fields cause the toner to hop between the adjacent electrodes and form toner clouds, which is a phenomenon hereinafter referred to as "toner flare" or "a flare state". Thus, the toner forms clouds around the outer circumferential surface of the developer carrier.

In this method, to prevent the toner from adhering to the outer circumferential surface of the developer carrier and secure the hopping of toner, it is important to maintain a proper relation between a force F1 applied to the toner by the electrical field (hereinafter "flare electrical field") formed between the different types of electrodes, adjacent to each other, and a force of adhesion between the toner and the outer circumferential surface of the developer carrier (adhesion force F2). If the force F1 is smaller than the adhesion force F2, the toner adheres to the outer circumferential surface of the developer carrier, thus failing to hop. By contrast, when the force F1 is greater than the adhesion force F2, the toner can hop. As the difference between the force F1 and the adhesion force F2 increases, the flare state becomes more stable. Although a stable flare state can be attained by increasing the force F1 to increase the difference, it is necessary to generate a greater flare electrical field on the outer circumferential surface of the developer carrier.

JP-2007-133388-A proposes a roller-shaped developer carrier including two types of electrodes (e.g., A-type electrode and B-type electrode) arranged concentrically with the developer carrier to generate the flare electrical fields. Two types of electrodes are shaped like combs and arranged in the circumferential direction of the developer carrier so that tooth portions of the A-type electrode are interposed between the two tooth portions of the B-type electrode. Then, different voltages are applied to the two types of electrodes to cause the toner to hop between the tooth portions, thereby attaining toner flare.

Additionally, JP-2008-116599-A proposes a roller-shaped developer carrier including three types of electrodes to generate the flare electrical fields. In this developer carrier, whereas first and second electrodes are arranged concentrically with the developer carrier, the third electrode is positioned outside the first and second electrodes, closer to the outer surface of the developer carrier. In this developer carrier, different voltages are applied to the three different electrodes to cause the toner to hop between the adjacent electrodes, thereby attaining the toner flare.

Although the out circumferential surface of the developer carrier is typically covered with an electrically insulative layer, the insulative surface layer is charged to the polarity opposite the polarity of the toner by triboelectric charging with the toner. Accordingly, the absolute value of the surface potential of the developer carrier increases as image development is repeated. As a result, development electrical fields change in size gradually, causing the image quality to fluctuate.

BRIEF SUMMARY OF THE INVENTION

In view of the foregoing, an embodiment of the present invention provides a development device for causing a developer to adhere to an electrostatic latent image formed on a latent image bearer. The development device includes a developer container for containing the developer, a rotary cylindrical developer carrier disposed in the developer container, facing the latent image bearer, and a first bias power source. The developer carrier includes an outer electrode including multiple electrode portions arranged in a circumferential direction of the developer carrier, an inner electrode provided on an inner circumferential side of the developer carrier from the outer electrode, an insulation layer disposed between the outer electrode and the inner electrode to insulate the inner electrode electrically from the outer electrode, and a surface layer provided on an outer side of the outer electrode. The first bias power source applies a first bias voltage and a second bias voltage to the inner electrode and the outer electrode, respectively, and generates an electrical potential difference that changes with time between the inner electrode and the outer electrode to cause the developer to hop on a circumferential surface of the developer carrier. At least one of the first bias voltage and the second bias voltage has a cyclic waveform in which pulse-on time is reduced.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
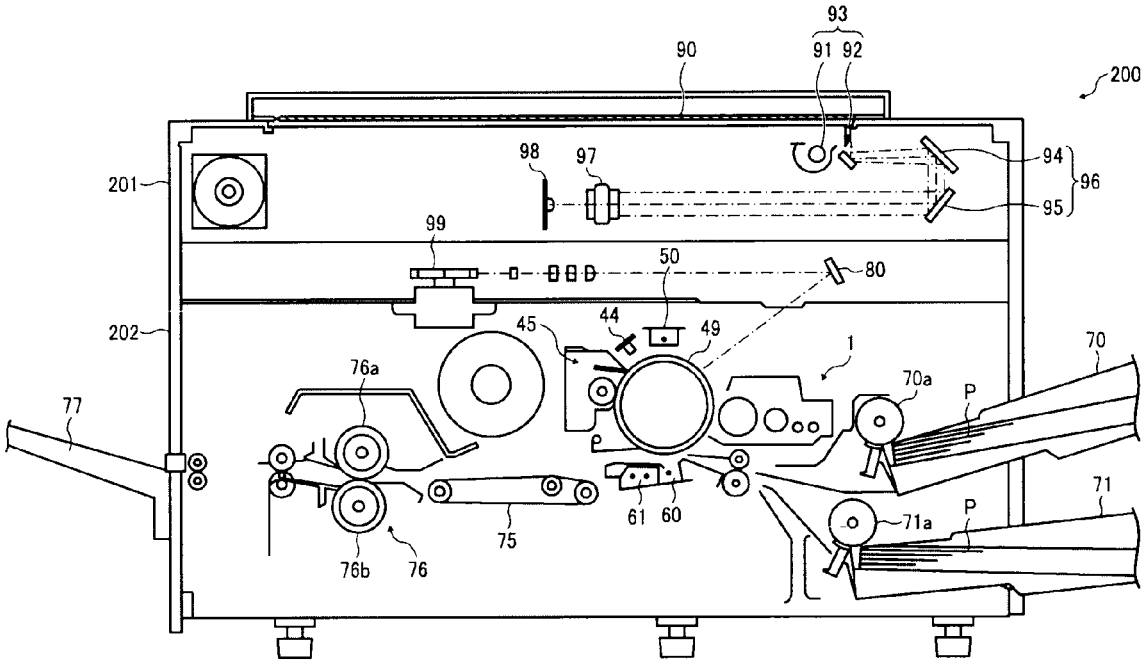
FIG. 1 is a schematic diagram illustrating an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an electrophotographic multicolor image forming apparatus according to an embodiment of the present invention is described.

First Embodiment

FIG. 1 is a schematic diagram illustrating a configuration of an image forming apparatus 200 according to the present embodiment.

The image forming apparatus 200 includes an image reading unit 201 and a main body 202. The image reading unit 201 includes a first optical system 93 and a second optical system 96 for reading image data of an original document placed on an exposure glass 90.

For example, the image forming apparatus 200 is a copier in the present embodiment and includes a drum-shaped photoreceptor 49, serving as an image bearer, that rotates clockwise in FIG. 1. When a user places the original document on the exposure glass 90 and presses a print start switch, the first optical system 93 and the second optical system 96 start moving and start reading image data of the original document. The first scanning 93 includes a document illumination light source 91 and a mirror 92. The second optical system 96 includes mirrors 94 and 95.

The image of the original document thus scanned is captured as image data by an image reading element 98 positioned on the back of a lens 97. The image data is digitalized, and image processing (e.g., color conversion, color calibration, and the like) thereof is performed. After the image processing, a laser diode (LD), not shown, is driven with a control signal. A polygon mirror 99 deflects a laser beam emitted from the laser diode, and then the laser beam scans a surface of the photoreceptor 49 via a mirror 80.

Before the above-described image scanning, a charging device 50 charges the surface of the photoreceptor 49 uniformly, and an electrostatic latent image is formed thereon when the laser beam scans the surface of the photoreceptor 49.

A development device 1 supplies developer (i.e., toner) to the latent image formed on the photoreceptor 49, thus forming a toner image thereon. As the photoreceptor 49 rotates, the toner image is transported to a transfer position facing a transfer charger 60. A sheet P (i.e., recording medium) is transported to the transfer position from a first sheet feeder 70 provided with a first feed roller 70*a* or a second sheet feeder 71 provided with a second feed roller 71*a*, timed to coincide with the arrival of the toner image on the photoreceptor 49. The toner image is then transferred from the photoreceptor 49 to the sheet P by corona discharging of the transfer charger 60.

Subsequently, the sheet P is separated from the surface of the photoreceptor 49 by corona discharging of a separation charger 61 and transported by a conveyance belt 75 to a fixing device 76. The fixing device 76 includes a fixing roller 76*a* in which a heat source such as a halogen heater is provided and a pressure roller 76*b* pressing against the fixing roller 76*a*, thus forming a fixing nip therebetween. The sheet P is clamped in the fixing nip. In the fixing nip, the toner image is fixed on the sheet P with heat from the fixing roller 76*a* and pressure exerted by the pressure roller 76*b*, after which the sheet P is discharged onto a discharge tray 77 provided outside the image forming apparatus 200.

A cleaning unit 45 removes any toner that is not transferred to the sheet P but adheres to the surface of the photoreceptor 49 after the photoreceptor 49 passes through the transfer position. Further, a discharge lamp 44 electrically discharges the surface of the photoreceptor 49 thus cleaned in preparation for subsequent formation of a latent image.

Figure 2:
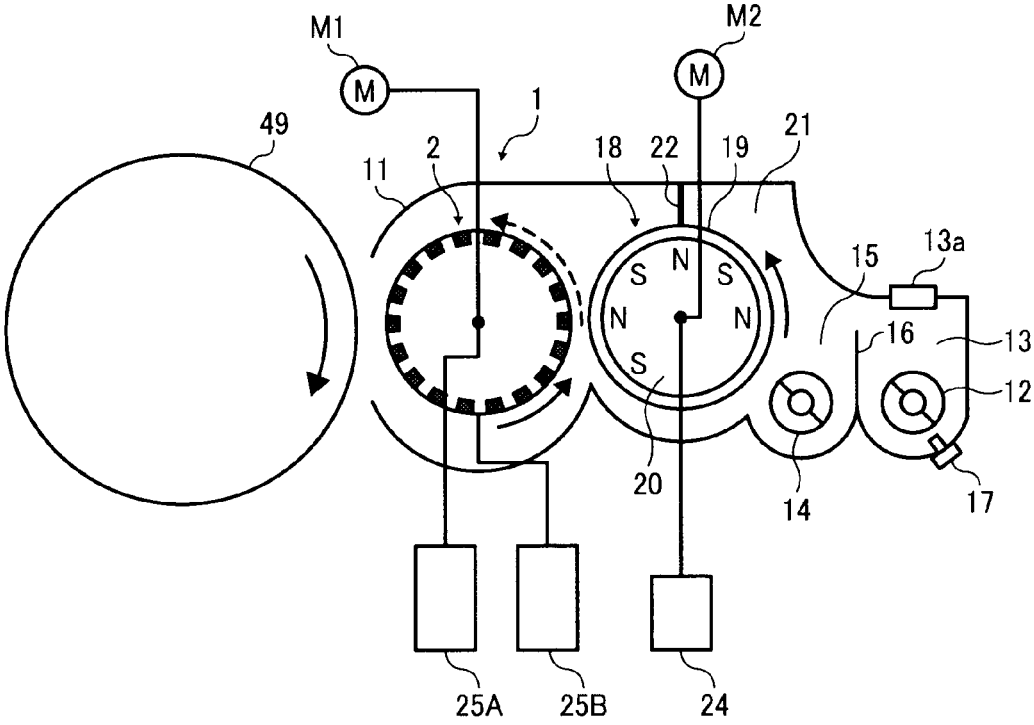
FIG. 2 is a schematic end-on axial view of a photoreceptor and a development device included in the image forming apparatus shown in FIG. 1.

FIG. 2 is a schematic end-on axial view of the photoreceptor 49 and the development device 1 according to the present embodiment.

The drum-shaped photoreceptor 49 is rotated clockwise in FIG. 2 by a driving unit, not shown. The development device 1 is provided on the right of the photoreceptor 49 in FIG. 2 and includes a toner-carrying roller 2 serving as a developer carrier. The development device 1 includes a casing 11 in which a first developer compartment 13, a second developer compartment 15, and a magnetic brush forming area 21 are formed.

The development device 1 further includes a first conveyance screw 12 that is provided in the first developer compartment 13 and rotates clockwise in FIG. 2, and a second conveyance screw 14 that is provided in the developer compartment 15 and rotates counterclockwise in FIG. 2. The first and second developer compartments 13 and 15 are divided by a partition 16 at least partly. The first and second developer compartments 13 and 15 contain developer that is a mixture of magnetic carrier particles (magnetic carrier) and toner particles (toner). The toner is charged to have a negative polarity in this configuration.

While mixing the developer in the first developer compartment 13, the first conveyance screw 12 transports by rotation the developer from the front side to the back side of the paper on which FIG. 2 is drawn. A toner concentration detector 17 is provided in a bottom portion of the first developer compartment 13 and detects the concentration of toner in the developer transported by the first conveyance screw 12. A first communication port is formed in an end portion of the partition 16 on the back side of the paper on which FIG. 2 is drawn, and the developer is transported from the first developer compartment 13 to the developer compartment 15 through first communication port.

The developer compartment 15 communicates with the magnetic brush forming area 21 in which a toner supply roller 18 is provided. The second conveyance screw 14 faces the toner supply roller 18 across a predetermined gap with their long axes in parallel to each other. While mixing the developer in the second developer compartment 15, the second conveyance screw 14 transports by rotation the developer from the back side to the front side of the paper on which FIG. 2 is drawn. The developer transported by the second conveyance screw 14 is partly supplied onto a surface of a cylindrical toner supply sleeve 19 of the toner supply roller 18. It is to be noted that the term "cylindrical" used in this specification is not limited to round columns but also includes polygonal prisms.

As the toner supply sleeve 19 rotates counterclockwise in FIG. 2, the developer passes through a toner supply position (described later), after which the developer leaves the surface of the toner supply sleeve 19 and is returned to the developer compartment 15. Subsequently, the developer is transported by the second conveyance screw 14 to an end portion on the front side of the paper on which FIG. 2 is drawn and further transported to the first developer compartment 13 through a second communication port formed in an end portion of the partition 16 on the front side.

For example, the toner concentration detector 17 is a magnetic permeability sensor. A voltage indicating the magnetic permeability detected by the toner concentration detector 17 is transmitted to a controller as a signal. Since the magnetic permeability of the developer (mixture) has a good correlation with the concentration of toner in the developer, the toner concentration detector 17 outputs a voltage corresponding to the toner concentration.

The controller of the image forming apparatus includes a storage device including a nonvolatile random access memory (RAM), in which a target voltage Vtref of the output voltage from the toner concentration detector 17 is stored. The controller compares the target voltage Vtref stored in the RAM with the voltage output from the toner concentration detector 17 and drives a toner supply device for a time period corresponding to the comparison result. Then, the toner supply device supplies toner through a toner supply inlet 13*a* to the first developer compartment 13 to compensate for the decrease in the toner concentration inherent to the consumption of toner used in image development. Thus, the concentration of toner in the developer contained in the developer compartment 15 can be kept in a predetermined or desirable range.

The toner supply roller 18 includes the cylindrical toner supply sleeve 19 formed of a nonmagnetic material and a magnet roller 20 provided inside the toner supply sleeve 19, fixed in position relative to the casing 11. The toner supply sleeve 19 rotates counterclockwise in FIG. 2. For example, the toner supply sleeve 19 can be produced by making a nonmagnetic material, such as aluminum, brass, stainless steel, or electroconductive resin, cylindrical. The magnet roller 20 includes multiple magnetic poles (N, S, N, S, N, and S poles counterclockwise from the top in FIG. 2) arranged in the direction of rotation of the toner supply sleeve 19. With the magnetic force generated by the multiple magnetic poles, the developer is adsorbed to the circumferential surface of the toner supply sleeve 19 and is caused to stand on end thereon, forming magnetic brushes.

As the toner supply sleeve 19 rotates, the developer pumped up to the surface of the toner supply sleeve 19 is transported counterclockwise in FIG. 2. Then, the developer enters a regulation gap where a developer regulator 22 faces the circumferential surface of the toner supply sleeve 19 across a predetermined gap. The amount of developer carried on the toner supply sleeve 19 is adjusted when the developer passes through the regulation gap between the developer regulator 22 and the toner supply sleeve 19.

The toner-carrying roller 2 is positioned on the left of the toner supply sleeve 19 in FIG. 2, facing the toner supply sleeve 19 across a predetermined gap, and rotates counterclockwise in FIG. 2, driven by a driving unit M1. After passing through the regulation gap, the developer reaches a toner supply position where the developer contacts the toner-carrying roller 2, as the toner supply sleeve 19 rotates, driven by a driving unit M2. Then, tips of the magnetic brush formed by the developer slide on the surface of the toner-carrying roller 2. The toner in the magnetic brush is supplied to the surface of the toner-carrying roller 2 by the sliding of the magnetic brush on the toner-carrying roller 2 and differences in electrical potential between the toner supply sleeve 19 and the toner-carrying roller 2.

It is to be noted that a supply-bias power source 24 applies a supply bias to the toner supply sleeve 19. The supply bias can be either a direct-current (DC) voltage or a DC voltage superimposed with an alternating-current (AC) voltage as long as the supply bias can generate an electrical field for moving the toner to the toner-carrying roller 2.

After passing through the toner supply position, the developer on the toner supply sleeve 19 is transported to a position facing the developer compartment 15 (hereinafter "release position") as the toner supply sleeve 19 rotates. Since no magnetic pole of the magnet roller 20 is positioned adjacent to the release position, there is no magnetic force for attracting the developer to the surface of the toner supply sleeve 19. Accordingly, the developer leaves the toner supply roller 18 and returns to the developer compartment 15. It is to be noted that, although the magnet roller 20 according to the present embodiment includes sixth magnetic poles, the number of the magnetic poles is not limited thereto and may be eight or twelve, for example.

An opening is formed in the casing 11 of the development device 1, and the circumferential surface of the toner-carrying roller 2 is exposed partially. The exposed circumferential surface of the toner-carrying roller 2 is positioned across a gap from several ten micrometers (μm) to several hundred micrometers from the photoreceptor 49. The portion where the toner-carrying roller 2 faces the photoreceptor 49 is the development area of the image forming apparatus 200.

While hopping thereon due to the factor described below, the toner supplied to the toner-carrying roller 2 is transported to the development range as the toner-carrying roller 2 rotates. In the development range, development electrical fields are generated between the toner toner-carrying roller 2 and the photoreceptor 49. The development electrical fields cause the toner to adhere to the electrostatic latent image formed on the surface of the photoreceptor 49, thus developing it into a toner image. As the toner-carrying roller 2 rotates, the toner that is not used in image development is transported further and is supplied to the development range repeatedly while hopping along the surface of the toner-carrying roller 2.

Next, a configuration of the toner-carrying roller 2 in the present embodiment is described in further detail below.

Figure 5:
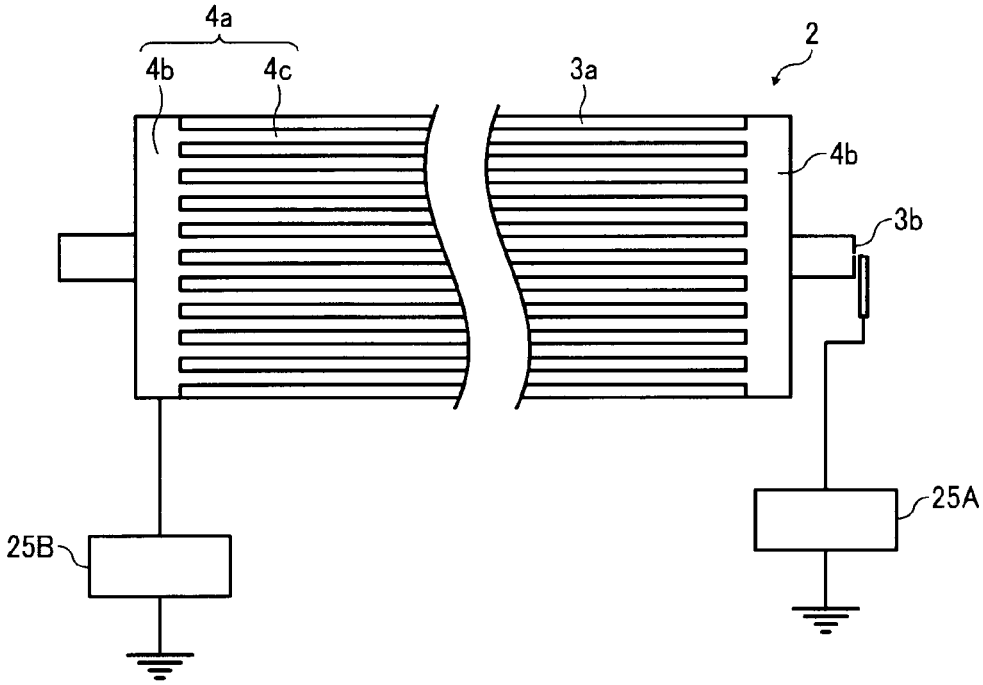
FIG. 5 is a schematic diagram of a toner-carrying roller of the development device shown in FIG. 2, as viewed in the direction perpendicular to the axis of rotation, and illustrates the arrangement of electrodes thereof.
Figure 6:
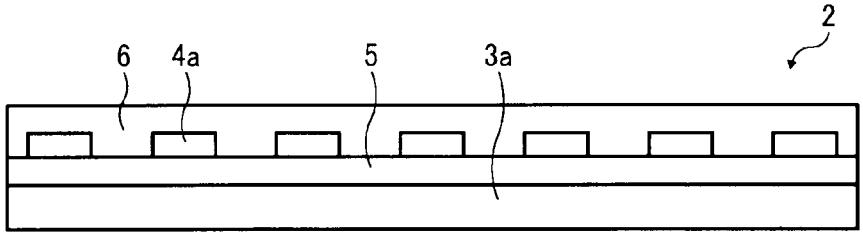
FIG. 6 is cross-sectional view of the toner-carrying roller shown in FIG. 5, along the direction perpendicular to the axial direction thereof and the cylindrical toner-carrying roller is developed like a flat plate.

FIG. 5 is a schematic diagram of the toner-carrying roller 2 as viewed in the direction perpendicular to the axial direction thereof and illustrates the arrangement of the electrodes thereof. FIG. 6 is cross-sectional view of the toner-carrying roller 2 along the direction perpendicular to the axial direction thereof and the cylindrical toner-carrying roller 2 is developed like a flat plate in FIG. 6.

The toner-carrying roller 2 shown in FIGS. 5 and 6 is formed with a hollow cylinder that includes an inner electrode 3*a* (first electrodes) as an innermost layer and an outer electrode 4*a* including multiple tooth portions 4*c* (second electrodes) positioned on the outer side of the inner electrode 3*a*. The toner-carrying roller 2 has a multilayered structure including the inner electrode 3*a*, an insulation layer 5, the outer electrode 4*a*, and a surface layer 6 in that order from inside.

It is to be noted that the surface layer 6 and the insulation layer 5 are omitted for easy of understanding in FIG. 5. In FIG. 5, reference character 3*b* represents a power receiving portion of the inner electrode 3*a* and 4*b* represents power receiving portions of the outer electrode 4*a*.

A voltage (i.e., an outer voltage) applied to the outer electrode 4*a* is different from a voltage (i.e., an inner voltage) applied to the inner electrode 3*a*. The tooth portions 4*c* of the outer electrode 4*a* are arranged at similar intervals like a comb. The insulation layer 5 is provided between the inner electrode 3*a* and the outer electrode 4*a* to insulate them from each other. Additionally, the surface layer 6 (surface coating) overlying the outer circumferential side of the outer electrode 4*a* serves as a protective layer.

The inner electrode 3*a* also serves as a base of the toner-carrying roller 2 and can be a roller formed of an electroconductive material. The inner electrode 3*a* can include SUS (Steel Use Stainless), aluminum, or the like. The inner electrode 3*a* can be manufactured by forming an electroconductive layer made of metal, such as aluminum or copper, on a surface of a resin roller. Examples of the material of the resin roller include polyacetal (POM) or polycarbonate (PC). The electroconductive layer can be manufactured through metal plating or vapor deposition. Alternatively, the metal layer may be bonded to the surface of the resin roller.

The outer circumferential side of the inner electrode 3*a* is covered with the insulation layer 5. The insulation layer 5 can be formed of polycarbonate, alkyd melamine, or the like in the present embodiment. In addition, it is preferable that the insulation layer 5 should have a thickness from 3 μm to 5 μm. If the thickness of the insulation layer 5 is thinner than 3 μm, insulation between the inner electrode 3*a* and the outer electrode 4*a* might become insufficient, thus increasing the possibility of leakage of electricity between the inner electrode 3*a* and the outer electrode 4*a*. By contrast, if the thickness of the insulation layer 5 is greater than 5 μm, generation of the electrical field to be formed outside the surface layer 6 is inhibited. As a result, it becomes difficult to form a sufficiently strong electrical field outside the surface layer 6. In the present embodiment, the insulation layer 5 is formed of melamine resin and has a thickness of 20 μm. Through a spraying method or dipping method, the insulating layer 5 having a uniform thickness can be formed on the inner electrode 3*a*.

Above the insulation layer 5, the multiple tooth portions (stripe electrodes) 4*c* are arranged at similar intervals in the circumferential direction, thus forming the outer electrode 4*a* shaped like a comb. The outer electrode 4*a* including the multiple tooth portions 4*c* can be formed of metal such as aluminum, copper, silver, or the like. Various types of methods are available to form the outer electrode 4*a*. For example, a metal layer can be formed on the insulation layer 5 through plating or vapor deposition, after which the metal layer can be etched into a comb shape by photoresist etching. Alternatively, electrodes arranged in a comb or ladder shape may be formed by causing an electroconductive paste to adhere to the insulation layer 5 through ink ejection or screen printing.

The outer circumferential side of the outer electrode 4*a* and portions of the insulation layer 5 where the outer electrode 4*a* is not present are covered with the surface layer 6. The toner is charged by friction with the surface layer 6 while hopping repeatedly on the surface layer 6. To give the toner a normal charge polarity, which in the present embodiment is negative, silicone, nylon (registered trademark), urethane, alkyd melamine, polycarbonate, or the like can be used as the material of the surface layer 6. For example, polycarbonate is used in the present embodiment.

Additionally, it is preferred that the surface layer 6 should have a layer thickness within a range of from about 3 μm to 40 μm since the surface layer 6 also serves as the protection layer. If thinner than 3 μm, the surface layer 6 may be abraded over time to expose the outer electrode 4*a*, and it is possible that electricity leaks through the toner carried on the toner-carrying roller 2 or components that contact the toner-carrying roller 2. By contrast, if the thickness of the surface layer 6 is greater than 40 μm, generation of the electrical field to be formed outside the surface layer 6 is inhibited. As a result, it becomes difficult to form a sufficiently strong electrical field outside the surface layer 6. In the present embodiment, the surface layer 6 has a thickness of 20 μm. The surface layer 6 can be produced by splaying or dipping similarly to the insulation layer 5.

The electrical fields for causing the toner to hop are generated due to the effects of the inner electrode 3*a* and the outer electrode 4*a*. More specifically, the electrical fields are formed by the effects of the outer electrode 4*a* (tooth portions 4*c*) and the portions of the inner electrode 3*a* that do not face the outer electrode 4*a* but positioned between the tooth portions 4*c* of the outer electrode 4*a*. The electrical fields generated outside the surface layer 6 cause the toner to hop along the surface of the toner-carrying roller 2 and to form toner clouds. At that time, the toner flies reciprocally back and forth, that is, hops on the surface of the toner-carrying 2 between portions facing the inner electrode 3*a* across the insulation layer 5 and portions facing the outer electrode 4*a*.

Although it is important to generate flare electrical fields of the corresponding size to form toner clouds reliably, the difference in the electrical potential between the inner electrode 3*a* and the outer electrode 4*a* should be relatively large to form such relatively large electrical fields. To reliably maintain such a large difference in electrical potential, it is important to insulate the inner electrode 3*a* from the outer electrode 4*a* reliably and effectively, thereby preventing leakage of electricity.

In a comparative configuration in which two types of electrodes are arranged concentrically like combs for generating the flare electrical field so that each tooth portion of one of them is interposed between the adjacent tooth portions of the other, if the quality of the comb-shaped electrodes is lower, insulation between the different electrodes adjacent to each other can decrease significantly, resulting in leakage of electricity. More specifically, the metal film that must be removed might remain partly when the electrodes are produced through etching, or gaps between adjacent electrodes might be filled with the conductive paste when the electrodes are produced through ink ejection or screen printing. In such cases, the possibility of leakage of electricity between the two types of electrodes is high, making it difficult to generate suitable flare electrical fields.

Further, in the comparative configuration, even if the quality of the comb-shaped electrodes formed on the resin layer of the roller is high, the outer side of them is then covered with an insulative material, that is, gaps between the electrodes are filled with the insulative material, to insulate them from each other. Then, an interface between the resin layer of the roller and the insulative material is formed between the electrodes, and the possibility of leakage of electricity through the interface is high. When a relatively large voltage is applied to the electrodes, the insulation between the electrodes can decrease significantly.

In view of the foregoing, the inner electrode 3*a* is covered with the insulation layer 5, and the comb-shaped outer electrode 4*a* is formed on the insulation layer 5 in the present embodiment. Thus, no interface, which can cause leakage of electricity, is present between the electrodes. In addition, in manufacturing the toner-carrying roller 2, the possibility that any conductive material is present between the electrodes, which can cause leakage of electricity, can be significantly low. Therefore, according to the present embodiment, reliable and effective insulation can be maintained between the inner electrode 3*a* and the outer electrode 4*a*, and leakage of electricity can be prevented effectively even when a relatively large voltage is applied to the electrodes.

Additionally, the width of each outer electrode 4*a* (tooth portion 4*c*) is preferably within a range of from about 10 μm to 120 μm. If the width of the outer electrode 4*a* is as thin as 10 μm or less, the outer electrode 4*a* might break. By contrast, if the width of the outer electrode 4*a* is as thick as 120 μm or greater, the voltage can be lower in portions away from the power receiving portions 4*b*. As a result, it becomes difficult to form stable toner clouds in that portion effectively. In the present embodiment, the power receiving portions 4*b* are positioned on the outer circumferential surface of axial end portions of the toner-carrying roller 2 as shown in FIG. 5. Therefore, in the present embodiment, if the width of the outer electrode 4*a* is thicker than 120 μm, the flare electrical fields can be weaker in a center portion than in end portions in the axial direction. Accordingly, it is difficult to cause the toner to hop in the axial center portion reliably and effectively.

Further, it is preferable that intervals (i.e., distance) between adjacent tooth portions 4*c* of the outer electrode 4*a* be equal to or greater than the width of the outer electrode 4*a*. If intervals between the tooth portions 4*c* are smaller than the width of the outer electrode 4*a*, it is possible that many of the lines of electrical force generated by the inner electrode 3*a* converge in the outer electrode 4*a* before extending outside the surface layer 6, and thus the electrical field generated outside the surface layer 6 becomes weaker. By contrast, if intervals between the tooth portions 4*c* are extremely large, the electrical field positioned in the axial center portion of the toner-carrying roller 2 might be weaker. Therefore, it is preferable that intervals between the tooth portions 4*c* be greater than the width thereof and equal to or less than five times the width.

In the present embodiment, intervals between the tooth portions 4*c* as well as the width thereof are 80 μm.

In addition, in the present embodiment, intervals between the tooth portions 4*c* are constant in the entire circumference of the toner-carrying roller 2. When intervals between the tooth portions 4*c* are constant, the electrical field for flare generated between the inner electrode 3*a* and the outer electrode 4*a* can be substantially uniform in the circumferential direction of the toner-carrying roller 2. Therefore, the toner can hop uniformly in the circumferential direction of the toner-carrying roller 2, and image development can be uniform in the circumferential direction.

Next, typical voltages (pulse voltages) applied to the inner electrode 3*a* and the outer electrode 4*a* are described below.

The pulse voltage supply units 25A and 25B apply the inner bias voltage (first voltage) and the outer voltage (second voltage) to the inner electrode 3*a* and the outer electrode 4*a* of the toner-carrying roller 2, respectively. The pulse voltage supply units 25A and 25B together form a first bias power source. Rectangular waves are more suitable as the waveform of the inner bias voltage and the outer bias voltage supplied by the pulse poser sources 25A and 25B. However, the inner bias voltage and the outer bias voltage are not limited to rectangular waves but may be triangular waves or those having sine curves. Additionally, in the present embodiment, a biphasic configuration including the inner electrode 3*a* and the outer electrode 4*a* is used for generating the electrical fields for flare, and phases of the voltages applied to the inner electrode 3*a* and the outer electrode 4*a* are different (difference in phase π).

Figure 7:
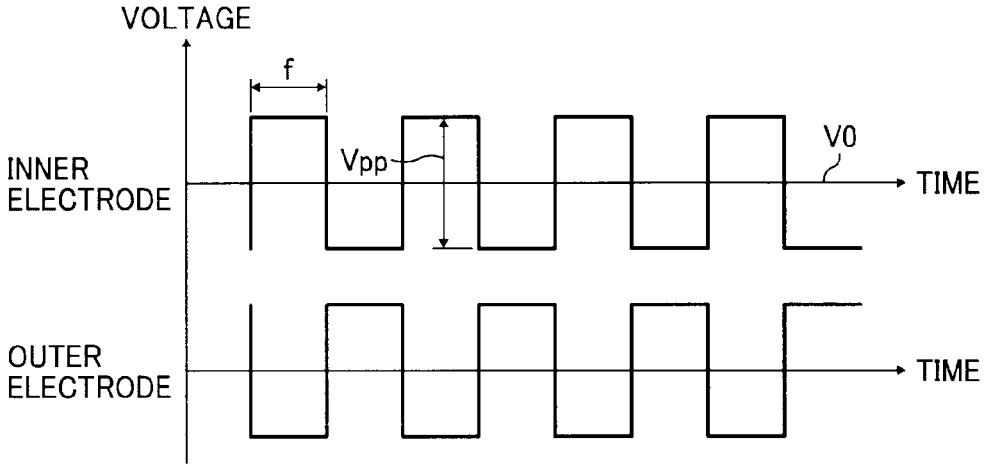
FIG. 7 is a graph that illustrates an example of an inner bias voltage and an outer bias voltage respectively applied to an inner electrode and outer electrode of the toner-carrying roller.

FIG. 7 is a graph that illustrates the inner bias voltage and the outer bias voltage respectively applied to the inner electrode 3*a* and the outer electrode 4*a* as examples.

In the present embodiment, the inner bias voltage and the outer bias voltage are rectangular waves and have an identical peak-to-peak voltage (Vpp), and their phases are shifted π from each other. Therefore, the difference between the inner bias voltage and the outer bias voltage equals to the peak-to-peak voltage Vpp constantly. The difference in voltage generates the electrical fields between the electrodes, and the toner is caused to hop along the surface of the toner-carrying roller 2 by the flare electrical fields generated outside the surface layer 6. In the present embodiment, the peak-to-peak voltage Vpp is preferably within a range of from 100 V to 2,000 V. If the peak-to-peak voltage Vpp is smaller than 100 V, a sufficient electrical field for flare cannot be formed above the surface layer 6, and it is difficult to cause the toner to hop thereon reliably. By contrast, if the peak-to-peak voltage Vpp is greater than 2,000 V, the possibility of leakage of electricity increases over time. In the present embodiment, for example, the peak-to-peak voltage Vpp is 500 V.

It is to be noted that, a center value V0 of the inner bias voltage and the outer bias voltage is within a range from the electrical potential of image portions where electrostatic latent images are present to the electrical potential of non-image portion, that is, the background of the image. The center value V0 varies depending on development conditions.

In the present embodiment, it is preferred that the frequency f of the inner bias voltage and the outer bias voltage be within a range from about 0.1 kHz to 10 kHz. If the frequency f is smaller than 0.1 kHz, it is possible that the hopping toner fails to keep up with the development velocity. By contrast, if the frequency f is greater than 10 kHz, movement of toner cannot follow the switching of the electrical fields, and it becomes difficult to cause the toner to hop reliably. In the present embodiment, the frequency f of the inner bias voltage and the outer bias voltage is 500 Hz, for example.

Figure 8:
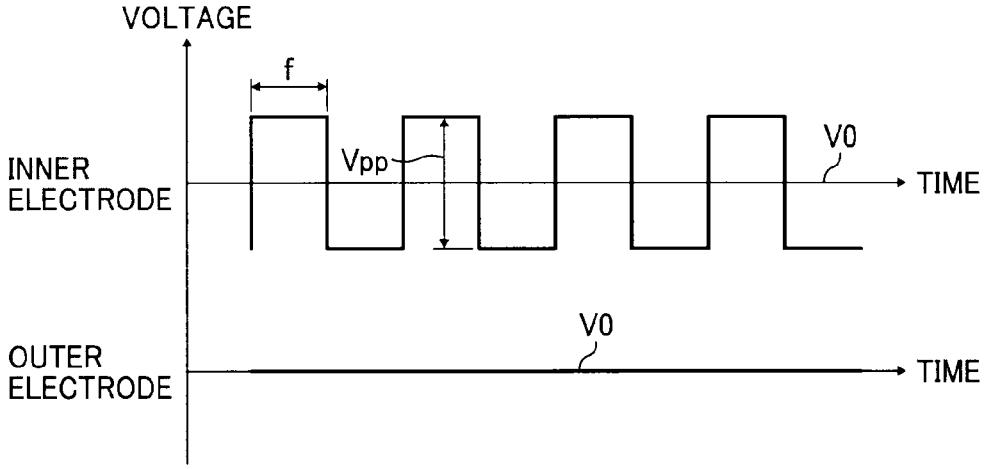
FIG. 8 is a graph that illustrates another example of the inner bias voltage and the outer bias voltage respectively applied to the inner electrode and the outer electrode of the toner-carrying roller.

FIG. 8 is a graph that illustrates another example of the inner bias voltage and the outer bias voltage respectively applied to the inner electrode 3*a* and the outer electrode 4*a*.

Although the inner voltage applied to the inner electrode 3*a* in this example is similar to that shown in FIG. 5, a DC voltage is applied to the outer electrode 4*a*. In this case, the difference in electrical potential between the electrodes is Vpp/2. Therefore, the preferable range of the peak-to-peak voltage Vpp in this case is from 200 V to 4,000 V. In this case, it is not necessary to take account of the difference in phase between the inner electrode 3*a* and the outer electrode 4*a*, and the cost of the power source can be lower similarly.

Figure 9:
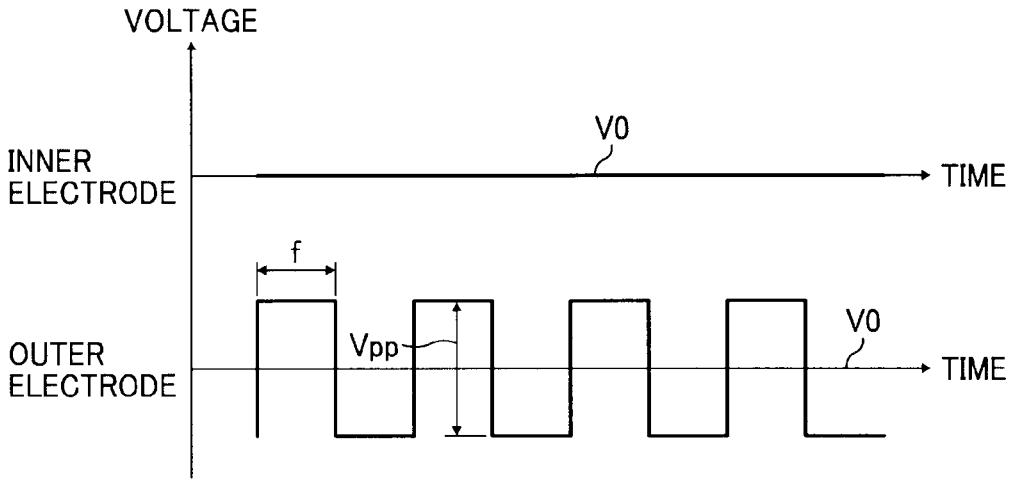
FIG. 9 is a graph that illustrates yet another example of the inner bias voltage and the outer bias voltage respectively applied to the inner electrode and the outer electrode of the toner-carrying roller.

FIG. 9 is a graph that illustrates another example of the inner bias voltage and the outer bias voltage respectively applied to the inner electrode 3*a* and the outer electrode 4*a*.

Although the outer voltage applied to the outer electrode 4*a* in this example is similar to that shown in FIG. 7, a DC voltage is applied to the inner electrode 3*a*. In this case, the difference in electrical potential between the electrodes is Vpp/2 as well. Therefore, the preferable range of the peak-to-peak voltage Vpp in this case is from 200 V to 4,000 V. In this case, it is not necessary to take account of the difference in phase between the inner electrode 3*a* and the outer electrode 4*a*, and the cost of the power source can be lower similarly.

Although the description above concerns typical voltage waveforms, preferable voltage waveforms applied to the inner electrode 3*a* and the outer electrode 4*a* according to the present embodiment are described below in relation to electrical discharge.

In development devices that involve causing toner to hop, typically, the outer circumferential surface of the developer carrier on which the toner hops should be insulative, and thus the developer carrier includes an insulation layer as a surface layer. If an electroconductive contact member positioned adjacent to the developer carrier, such as a doctor blade to adjust the thickness of toner carried on the developer carrier, contacts the electrodes for generating the flare electrical field, it is possible that electricity leaks through the electroconductive member. Therefore, the insulation layer is formed to prevent leakage of electricity.

In the case of developer carriers that include an insulative surface layer, as the toner hops and repeatedly contacts the outer circumferential surface of the developer carrier, the insulative surface layer is charged to the polarity opposite the polarity of the toner by triboelectric charging with the toner. Accordingly, the absolute value of the surface potential of the developer carrier increases as image development is repeated. As a result, the development field formed in a development range gradually changes in size, and the image quality changes over time.

Although this phenomenon can occur also in typical one-component development methods that do not involve causing toner to hop, the insulative outer circumferential surface is not essential in such one-component development methods, and as the surface layer of the developer carrier, a layer having an intermediate resistance lower than that of the insulation layer (hereinafter "intermediate-resistance surface layer") is applicable. When such an intermediate-resistance surface layer is used, the electrical charge generated on the outer surface of the developer carrier by triboelectric charging with the toner can be released to the electroconductive contact member, such as a doctor blade, that contacts the surface of the developer carrier, and the above-described problem can be solved.

By contrast, in development methods involving causing toner flare, if the developer carrier includes such an intermediate-resistance surface layer, the flare electrical field generated around the outer circumferential surface of the developer carrier is reduced in size compared with configurations using insulation surface layers. More specifically, in such a configuration, the electrical field moves inside the intermediate-resistance surface layer, and the electrical charge moves, which makes the flare electrical field weaker. As a result, it becomes difficult to cause toner to hop.

In addition, in the configuration using the intermediate-resistance surface layer if the bias applied to the electrodes of the developer carrier is increased to make the flare electrical field larger, the insulation between the electrodes might be broken, causing leakage of electricity between the electrodes. In this case, it is possible that the flare electrical field itself cannot be formed.

Therefore, to remove the above-described electrical charge caused by toner hopping, a difference in electrical potential is given between the developer carrier and the developer supply member, or the developer carrier and the doctor blade, is to cause electrical discharge intentionally.

The electrical discharge, however, can break molecular chains of the surface layer of the developer carrier, abrading the surface layer gradually. The abrasion of the surface layer changes the size of the development field formed in the development range gradually, and the image quality changes over time. Moreover, if the surface layer is removed, it is possible that the electrode thereunder is peeled off by sliding contact and the capability to generate toner flare is lost.

Electrical discharge is described in further detail below with reference to FIGS. 3 and 4.

Figure 3:
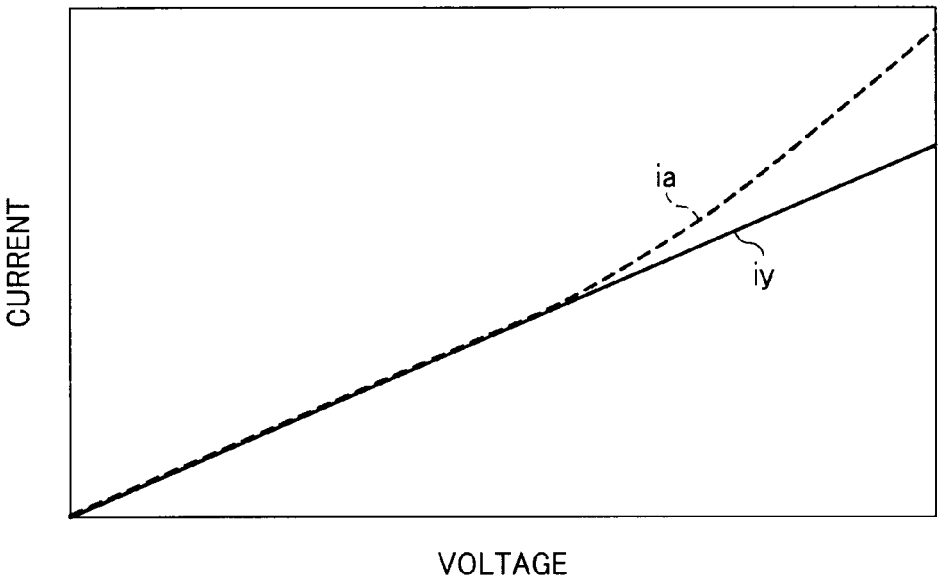
FIG. 3 is a graph that illustrates the relation between a voltage applied between a developer carrier and a contact member and an electrical current flowing between the developer carrier and the contact member.
Figure 4:
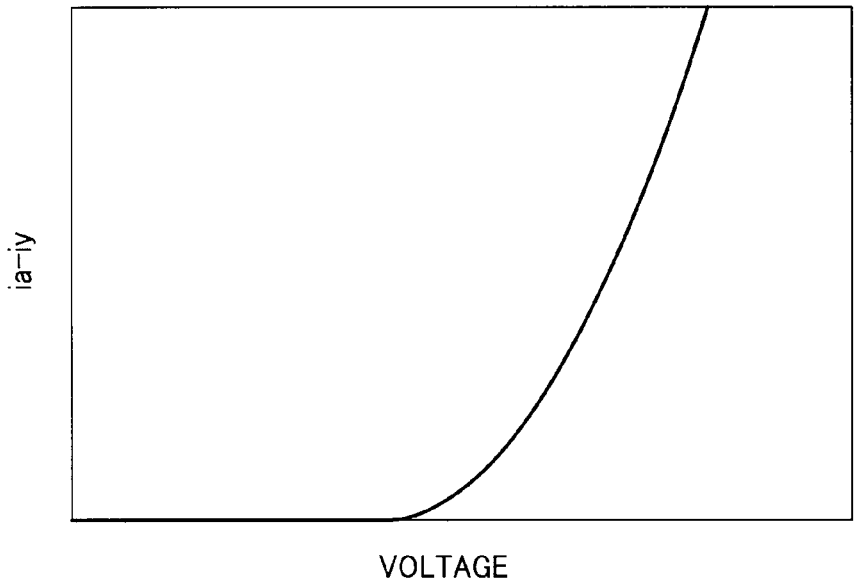
FIG. 4 is a graph that illustrates the relation between disjunction component ia-iy and the voltage applied between the developer carrier and the contact member based on the proportional relation with the current shown in FIG. 3.

FIG. 3 is a graph that illustrates the relation between the voltage applied between the developer carrier and the contact member and an electrical current flowing between the developer carrier and the contact member. Referring to FIG. 3, the electrical current flowing therebetween is a value (current iy) proportional to a capacity component between the developer carrier and the contact member as the difference in potential between the developer carrier and the contact member increases up to a given value. However, the electrical current becomes a value (current ia) greater than the proportional relation between the voltage and current when the difference in potential therebetween is greater than the given value.

When a voltage greater than the discharge start voltage is applied between the developer carrier and the contact member, electrical discharge occurs. The electrical discharge makes the distribution of electrical charge between the developer carrier and the contact member uneven. A disjunction component (ia-iy shown in FIG. 4) from the proportional relation of the current arises to resolve the unevenness in the electrical charge distribution. The disjunction component of the current from the proportional relation is called "discharge current".

In view of the foregoing, in the present embodiment, the waveform of the input voltage applied to at least one of the first electrode (inner electrode 3*a*) and the second electrode (outer electrode 4*a*) is changed to reduce the discharge current, thereby inhibiting (slowing) the abrasion of the surface layer of the developer carrier. Alternatively, the waveform of the input voltage applied to the contact member (developer supply roller or doctor blade) may be changed. Thus, the development field can be kept constant in size, and durability can be enhanced. Inhibiting abrasion of the surface layer of the developer carrier can also prevent the electrode layer from being exposed and peeled off. Accordingly, leakage of electricity due to the abrasion of the surface layer can be prevented, reducing the loss of the flare electrical field.

Preferable waveforms of voltages applied to the inner electrode 3*a* and the outer electrode 4*a* according to the present embodiment are described below with reference to FIGS. 10 through 18.

[First Waveform]

Figure 10:
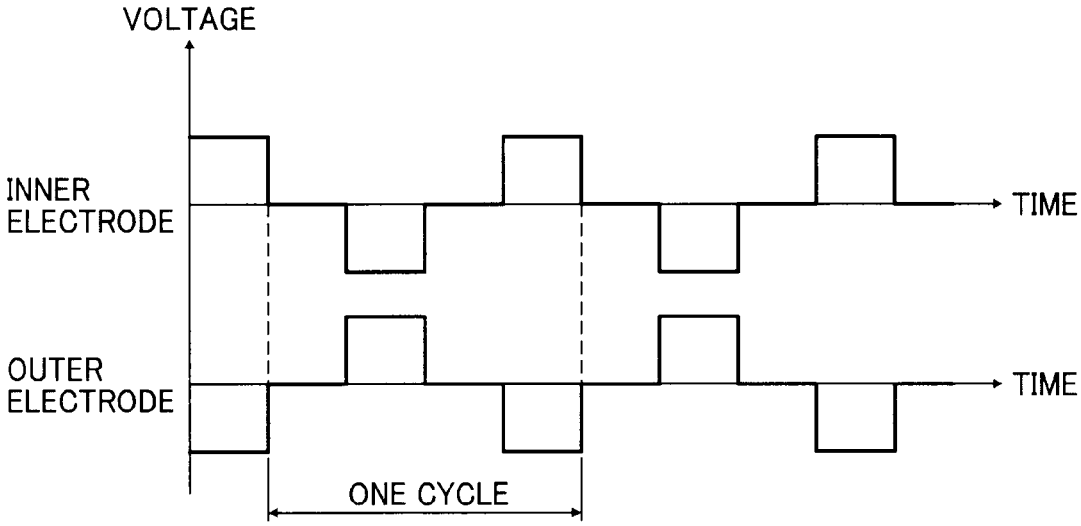
FIG. 10 is a graph that illustrates a waveform of the inner bias voltage and the outer bias voltage respectively applied to the inner electrode and the outer electrode according to an embodiment.

FIG. 10 is a graph that illustrates a first waveform of the inner bias voltage and the outer bias voltage respectively applied to the inner electrode 3*a* and the outer electrode 4*a* according to the present embodiment.

In the configuration shown in FIG. 10, pulse-on time of the voltage applied to either the inner electrode 3*a* or the outer electrode 4*a* is reduced to 50%. In this case, because the time during which the difference in electrical potential is present between the developer carrier and the contact member (i.e., the toner supply roller 18 and the doctor blade) is reduced by half, the number of times discharge occurs is reduced, and the discharge current is reduced. The reduction in the discharge current can reduce abrasion (i.e., decreases in thickness) of the surface layer 6 and the size of the development electrical field can be kept constant. Thus, the durability can be enhanced. In addition, since the abrasion of the surface layer 6 can be reduced, loss of the flare electrical fields by the leakage of electricity resulting from the abrasion of the surface layer 6 can be inhibited. It is to be noted that, although FIG. 10 illustrates the voltage waveform in which the pulse-on time is reduced to 50%, the pulse-on time may be within a range of from 20% to 50% of one cycle in the present embodiment.

In the present embodiment, the peak-to-peak voltage Vpp is preferably within a range of from 100 V to 2,000 V. If the peak-to-peak voltage Vpp is smaller than 100 V, a sufficient electrical field for flare cannot be formed above the surface layer 6, and it is difficult to cause the toner to hop thereon reliably. By contrast, if the peak-to-peak voltage Vpp is greater than 2,000 V, the possibility of leakage of electricity increases over time. In the present embodiment, for example, the peak-to-peak voltage Vpp is 500 V.

[Second Waveform]

Figure 11:
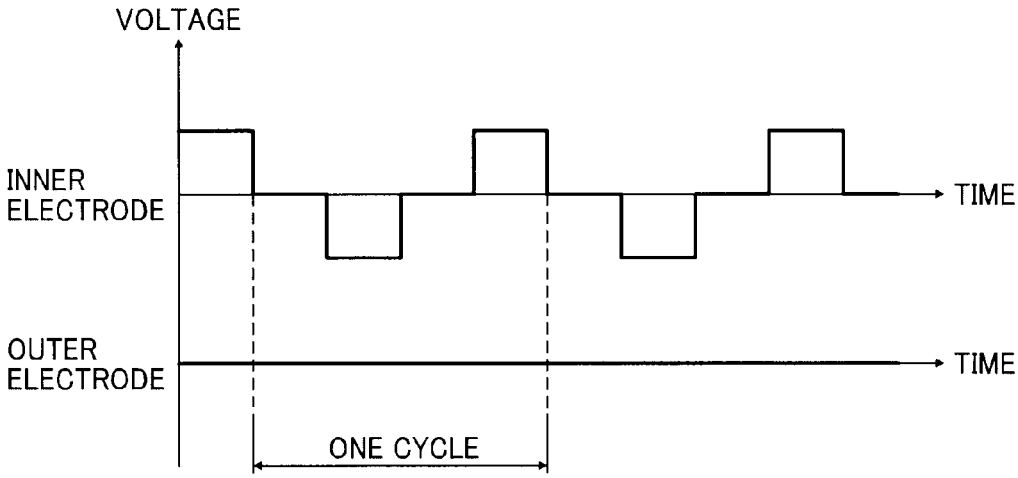
FIG. 11 is a graph that illustrates another waveform of the inner bias voltage and the outer bias voltage respectively applied to the inner electrode and the outer electrode according to an embodiment.

FIG. 11 is a graph that illustrates another example of the inner bias voltage and the outer bias voltage respectively applied to the inner electrode 3*a* and the outer electrode 4*a*.

Although the inner voltage applied to the inner electrode 3*a* in this example is similar to that shown in FIG. 10, a DC voltage is applied to the outer electrode 4*a*. In this case, the difference in electrical potential between the electrodes is Vpp/2. Therefore, the preferable range of the peak-to-peak voltage Vpp in this case is from 200 V to 4,000 V. In this case, it is not necessary to take account of the difference in phase between the inner electrode 3*a* and the outer electrode 4*a*, and the cost of the power source can be lower similarly.

[Third Waveform]

Figure 12:
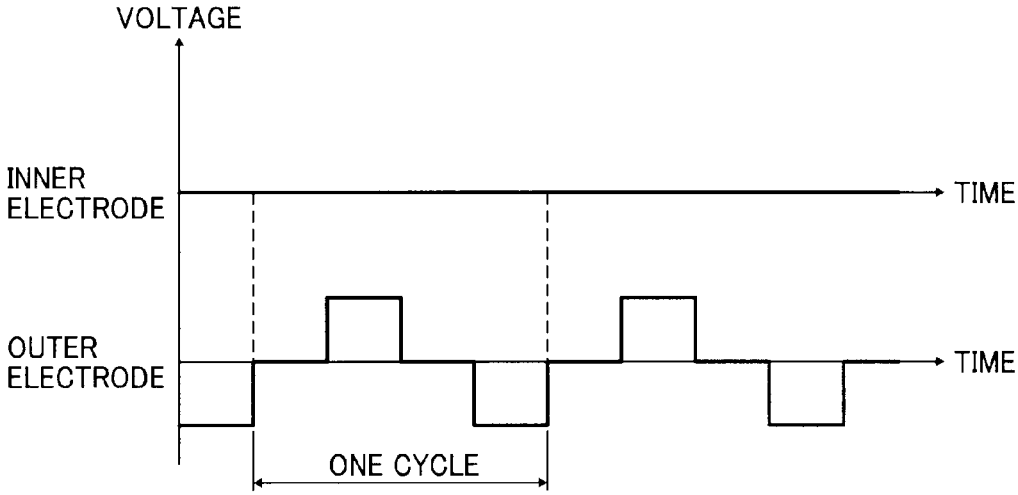
FIG. 12 is a graph that illustrates yet another waveform of the inner bias voltage and the outer bias voltage respectively applied to the inner electrode and the outer electrode according to an embodiment.

FIG. 12 is a graph that illustrates yet another example of the inner bias voltage and the outer bias voltage respectively applied to the inner electrode 3*a* and the outer electrode 4*a*.

Although the outer voltage applied to the outer electrode 4*a* in this example is similar to that shown in FIG. 10, a DC voltage is applied to the inner electrode 3*a*. In this case, the difference in electrical potential between the electrodes is Vpp/2 as well. Therefore, the preferable range of the peak-to-peak voltage Vpp in this case is from 200 V to 4,000 V. In this case, it is not necessary to take account of the difference in phase between the inner electrode 3*a* and the outer electrode 4*a*, and the cost of the power source can be lower similarly.

[Fourth Waveform]

Figure 13:
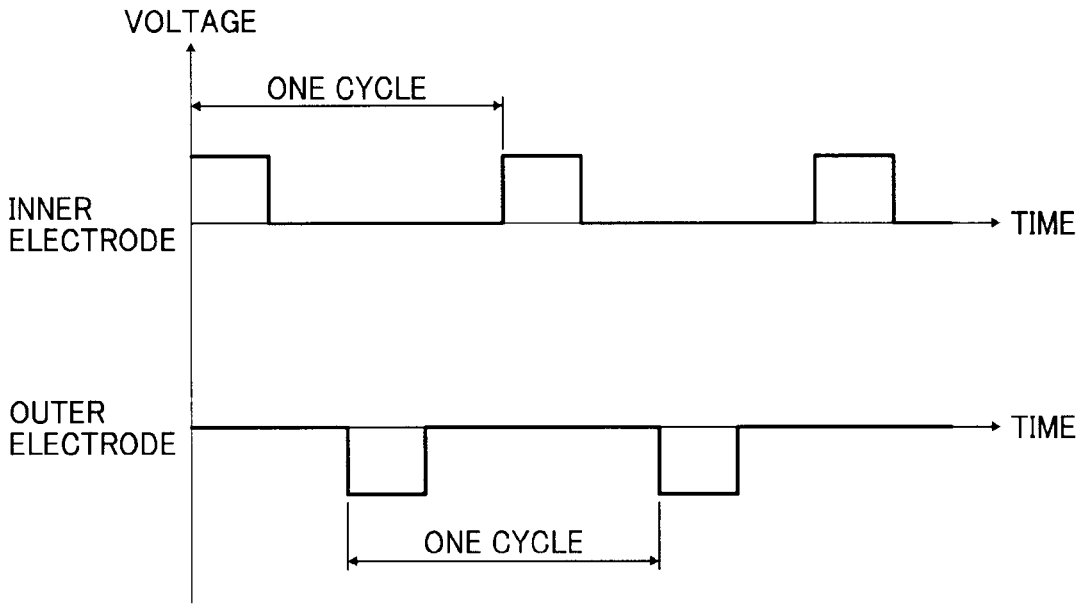
FIG. 13 is a graph that illustrates yet another waveform of the inner bias voltage and the outer bias voltage respectively applied to the inner electrode and the outer electrode according to an embodiment.

FIG. 13 is a graph that illustrates yet another example of the inner bias voltage and the outer bias voltage respectively applied to the inner electrode 3*a* and the outer electrode 4*a*.

In FIG. 13, the inner voltage applied to the inner electrode 3*a* has the intermediate potential and the maximum potential in FIG. 10, and the outer voltage applied to the outer electrode 4*a* has the intermediate potential and the minimum potential in FIG. 10. In this case, the difference in electrical potential between the electrodes is Vpp/2. Therefore, the preferable range of the peak-to-peak voltage Vpp in this case is from 200 V to 4,000 V. In this configuration, it is not necessary to provide three different potentials to a single electrode, thus reducing the cost of the power source.

[Fifth Waveform]

Figure 14:
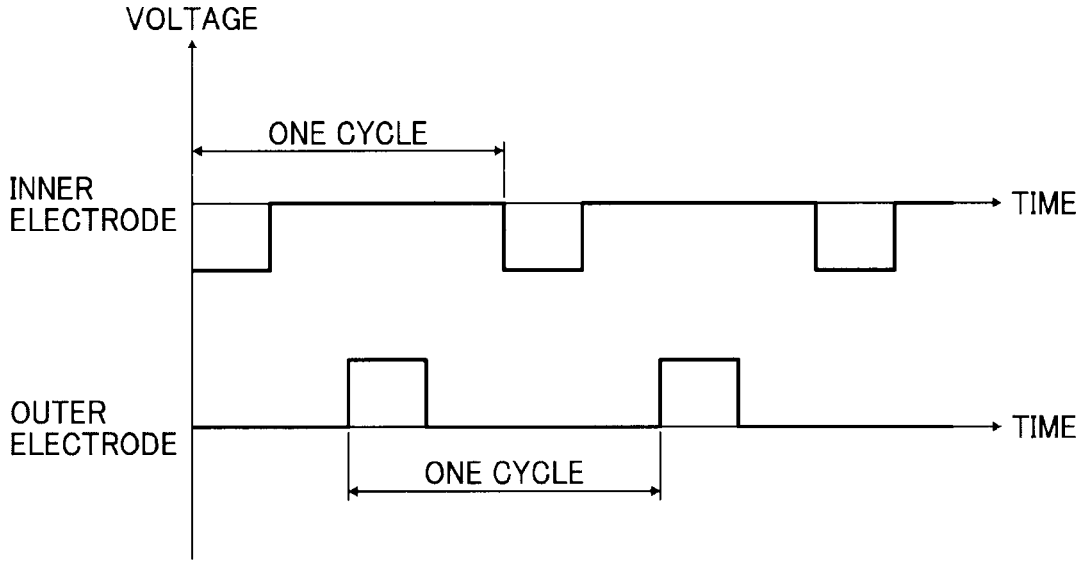
FIG. 14 is a graph that illustrates yet another waveform of the inner bias voltage and the outer bias voltage respectively applied to the inner electrode and the outer electrode according to an embodiment.

FIG. 14 is a graph that illustrates yet another example of the inner bias voltage and the outer bias voltage respectively applied to the inner electrode 3*a* and the outer electrode 4*a*.

In FIG. 14, the outer voltage applied to the outer electrode 4*a* has the intermediate potential and the maximum potential in FIG. 10, and the inner voltage applied to the inner electrode 3*a* has the intermediate potential and the minimum potential in FIG. 10. In this case, the difference in electrical potential between the electrodes is Vpp/2. Therefore, the preferable range of the peak-to-peak voltage Vpp in this case is from 200 V to 4,000 V. In this configuration, it is not necessary to provide three different potentials to a single electrode, thus reducing the cost of the power source.

[Sixth Waveform]

Figure 15:
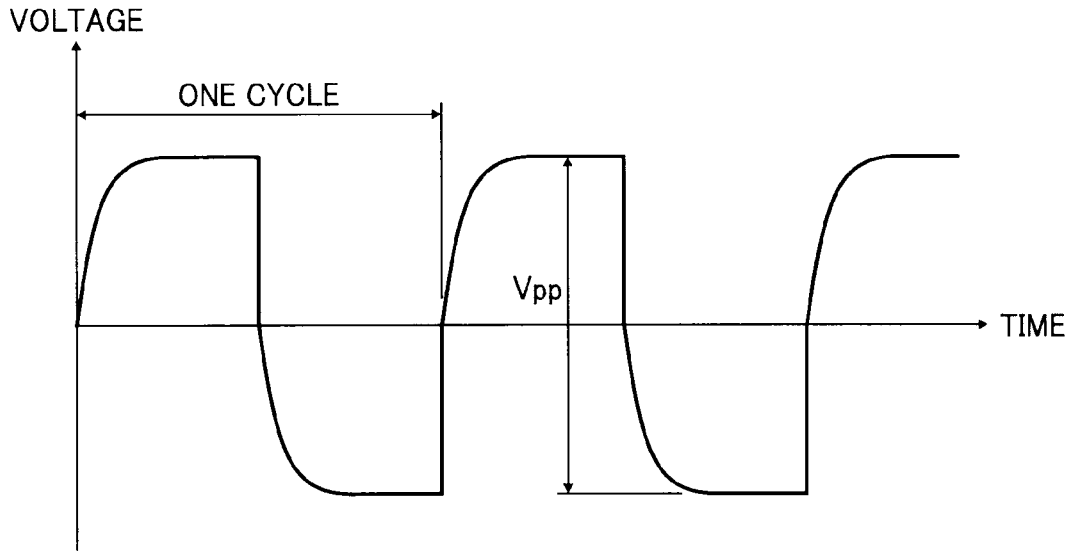
FIG. 15 is a graph that illustrates yet another waveform of the inner bias voltage and the outer bias voltage respectively applied to the inner electrode and the outer electrode according to an embodiment.

FIG. 15 is a graph that illustrates yet another example of the voltage applied to either the inner electrode 3*a* or the outer electrode 4*a*.

In FIG. 15, a voltage whose rise time is increased (that is, the voltage that rises slowly) is applied to either the inner electrode 3*a* or the outer electrode 4*a*. In this case, because the time during which the difference in electrical potential between the developer carrier and the contact member (i.e., the toner supply roller and the doctor blade) is greater than the discharge current can be reduced, the number of times discharge occurs is reduced, and the discharge current is reduced. The reduction in the discharge current can reduce abrasion (i.e., decreases in thickness) of the surface layer 6 and the size of the development electrical field can be kept constant. Thus, the durability can be enhanced. In addition, since the abrasion of the surface layer 6 can be reduced, loss of the flare electrical fields by the leakage of electricity resulting from the abrasion of the surface layer 6 can be inhibited.

Further, similarly to FIGS. 8 and 9, a DC voltage may be used as the voltage applied to either the inner electrode 3*a* or the outer electrode 4*a*, thus reducing the cost of the power source.

[Seventh Waveform]

Figure 16:
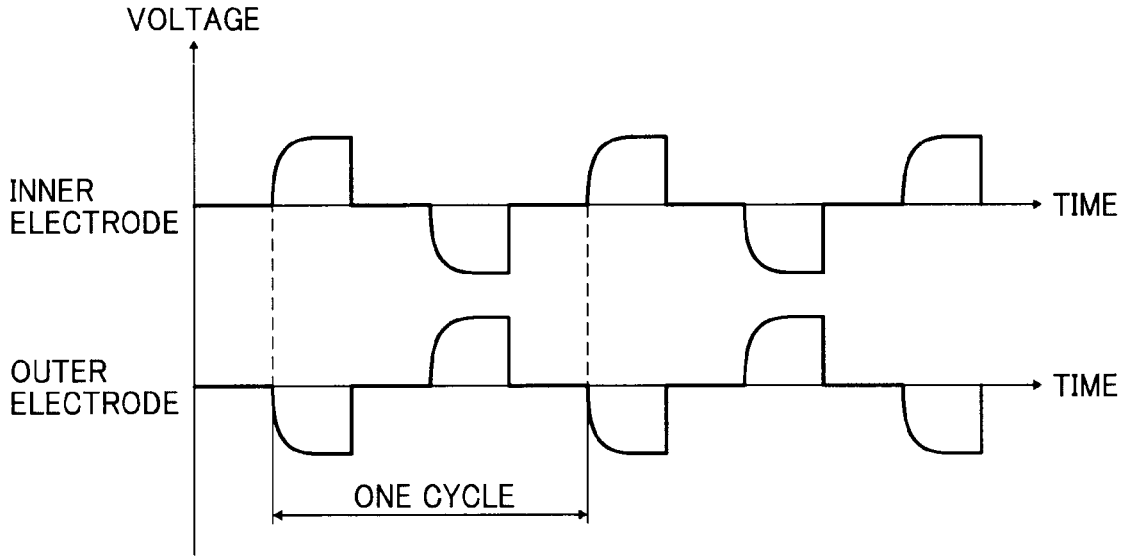
FIG. 16 is a graph that illustrates yet another waveform of the inner bias voltage and the outer bias voltage respectively applied to the inner electrode and the outer electrode according to an embodiment.

FIG. 16 is a graph that illustrates yet another example of the inner bias voltage and the outer bias voltage respectively applied to the inner electrode 3*a* and the outer electrode 4*a*.

The seventh waveform shown in FIG. 16 is such a voltage that the voltage waveform shown in FIG. 10 whose pulse-on time is reduced and the sixth waveform shown in FIG. 15 whose rise time is increased are combined. Such a combination can reduce the discharge current further.

[Eighth Waveform]

Figure 17:
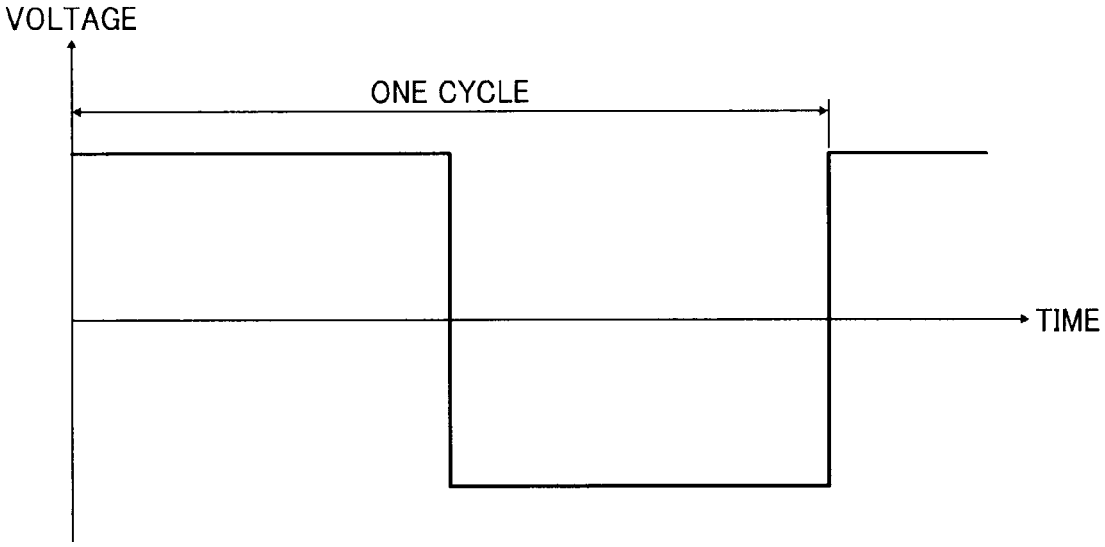
FIG. 17 is a graph that illustrates yet another waveform of the inner bias voltage and the outer bias voltage respectively applied to the inner electrode and the outer electrode according to an embodiment.

FIG. 17 is a graph that illustrates yet another example of the inner bias voltage and the outer bias voltage respectively applied to the inner electrode 3*a* and the outer electrode 4*a*.

In the configuration shown in FIG. 17, the frequency of the voltage applied to either the inner electrode 3*a* or the outer electrode 4*a* is reduced. Currently, the frequency range in practice is, for example, from 500 Hz to 1,000 Hz. Generally, a lower limit of the range of frequency at which toner can hop is 70% of typical frequency, which is about 700 Hz. Therefore, the reduced frequency according to the present embodiment can be within a range of from about 300 Hz to about 500 Hz, for example.

As the frequency decreases, the cycle of the voltage waveform is expanded, and the current component proportional to the capacitor's capacity decreases. Accordingly, the discharge current decreases. The reduction in the discharge current can reduce abrasion (i.e., decreases in thickness) of the surface layer 6 and the size of the development electrical field can be kept constant. Thus, the durability can be enhanced. In addition, since the abrasion of the surface layer 6 can be reduced, loss of the flare electrical fields by the leakage of electricity resulting from the abrasion of the surface layer 6 can be inhibited.

Further, similarly to FIGS. 8 and 9, a DC voltage may be used as the voltage applied to either the inner electrode 3*a* or the outer electrode 4*a*, thus reducing the cost of the power source.

[Ninth Waveform]

Figure 18:
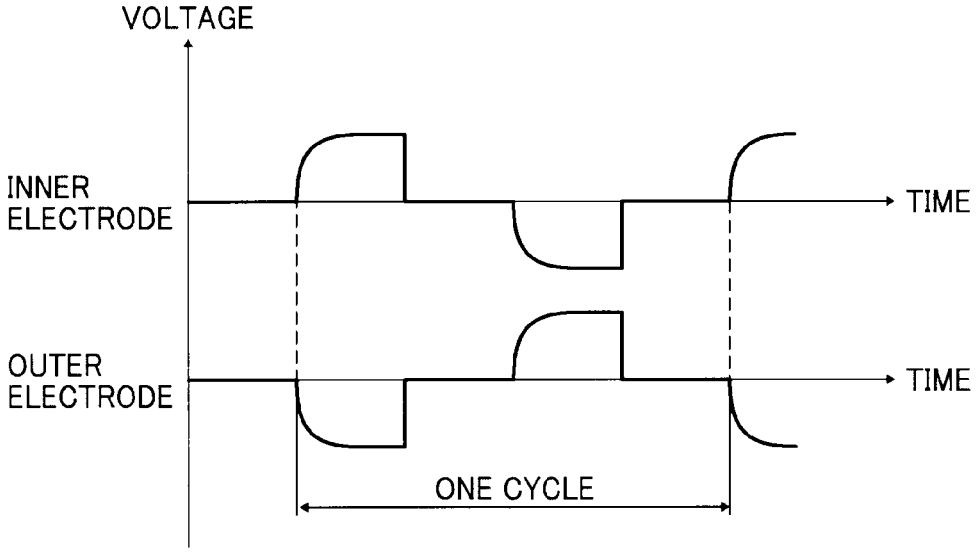
FIG. 18 is a graph that illustrates yet another waveform of the inner bias voltage and the outer bias voltage respectively applied to the inner electrode and the outer electrode according to an embodiment.

FIG. 18 is a graph that illustrates yet another example of the inner bias voltage and the outer bias voltage respectively applied to the inner electrode 3*a* and the outer electrode 4*a*.

The waveform shown in FIG. 18 is such a voltage that the voltage waveform shown in FIG. 10 whose pulse-on time is reduced, the sixth waveform shown in FIG. 15 whose rise time is increased, and the eighth waveform shown in FIG. 17 whose frequency is reduced are combined. Such a combination can reduce the discharge current further.

Although the description above concerns the voltages applied to the inner electrode 3*a* and the outer electrode 4*a* of the toner-carrying roller 2, a bias voltage having the above-described waveform may be applied to either the toner supply roller 18 or the doctor blade disposed facing the toner-carrying roller 2, or both to reduce the discharge further.

Second Embodiment

A structure of the power supply unit to the development device 1 according to a second embodiment is described below.

Figure 19:
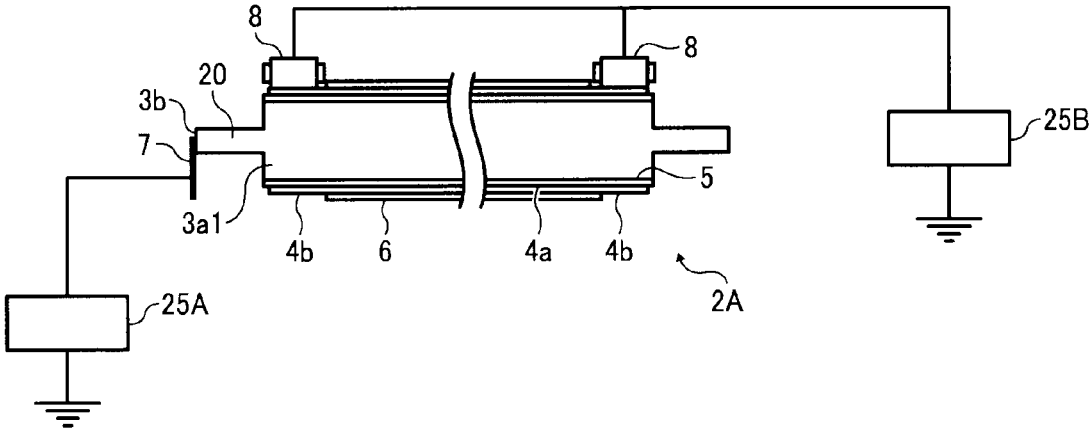
FIG. 19 is a schematic cross-sectional view of the toner-carrying roller along the axial direction and illustrates a configuration of a power supply unit to the inner electrode and the outer electrode.
Figure 20:
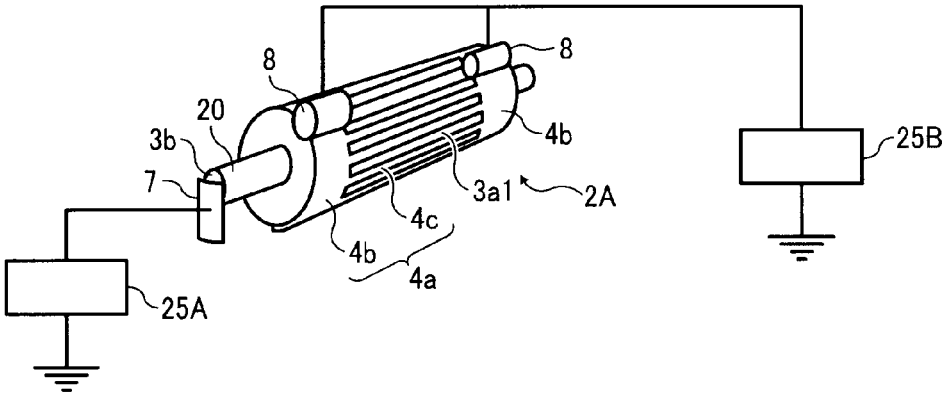
FIG. 20 is a schematic perspective view of the toner-carrying roller that illustrates the power supply configuration shown in FIG. 19.

FIG. 19 is a schematic cross-sectional view of a toner-carrying roller 2A along the axial direction together with a power supply structure to an inner electrode 3*a*1 and an outer electrode 4*a* thereof. FIG. 20 is a schematic perspective view of the toner-carrying roller 2A together with the power supply structure shown in FIG. 19. In the configuration shown in FIGS. 19 and 20, the toner-carrying roller 2A includes the inner electrode 3*a*1, an insulation layer 5, the outer electrode 4*a*, and a surface layer 6. The power supply structure includes power supply units (pulse power sources) 25A and 25B, a power supply brush 7, and power supply rollers 8.

In the configuration shown in FIGS. 19 and 20, the inner electrode 3*a*1 is united with a roller shaft (shaft portion 20) of the toner-carrying roller 2A as a single unit. An edge face of the shaft portion 20 serves as a power receiving portion 3*b*. The power supply brush 7 (first power supply member) connected to the power supply unit 25A is in contact with the power receiving portion 3*b* that is the edge face of the shaft portion 20. Axial end portions of the toner-carrying roller 2A are not covered with the surface layer 6, and the exposed portions of the outer surface of the toner-carrying roller 2A serve as power receiving portions 4*b*. The power supply rollers 8 (second power supply members) connected to the power supply unit 25B is in contact with the power receiving portions 4*b* that are the exposed surface of the toner-carrying roller 2A. The power supply rollers 8 are rotatively supported by, for example, the casing of the development device. As the toner-carrying roller 2A rotates, the power supply rollers 8 rotate while in contact with the power receiving portions 4*b*.

It is to be noted that, although two power supply rollers 8 are provided in the present embodiment, the number of the second power supply members to apply the outer voltage to the outer electrode 4*a* is not limited thereto but may be one, three, or greater. In configurations in which multiple power supply members are used to apply the outer voltage to the outer electrode 4*a*, even if one or some of them are in poor contact with the power receiving portion 4*b*, causing power supply failure, power can be supplied by the rest of them. Therefore, reliable power supply can be attained.

Additionally, in configurations in which the outer electrode 4*a* is partly exposed on the outer circumferential surface of the toner-carrying roller 2A and the second power supply members are in contact therewith to supply power thereto as in the present embodiment, it is preferable that the power receiving portions 4*b* be positioned outside in the axial direction from the development range, that is, the range facing an image area of the photoreceptor in which electrostatic latent images can be formed. If the power receiving portions 4*b* are positioned within the development range, toner particles compressed between the toner-carrying roller 2A and the power receiving portions 4*b* can contribute to image development, resulting in defective image development. More preferably, the power receiving portions 4*b* are positioned outside in the axial direction from the range of toner supply on the toner-carrying roller 2 (to which toner is supplied from the toner supply sleeve 19). If the power receiving portions 4*b* are positioned within the toner supply range, a large amount of toner can present between the toner-carrying roller 2A and the power receiving portions 4*b*, increasing the possibility of defective power supply. Therefore, in the present embodiment, the power receiving portions 4*b* are positioned outside the toner supply range in the axial direction of the toner-carrying roller 2A. Moreover, in the present embodiment, a seal is provided on an inner side of each power receiving portion 4*b* (the side closer to the axial center portion) to prevent the toner in the toner supply range from adhering to the power receiving portions 4*b* although not shown in the drawings.

It is to be noted that the second power supply members are not limited to the power supply rollers 8 that rotate as the power receiving portions 4*b* rotate. Alternatively, electroconductive brushes or electroconductive leaf springs may be used. When electroconductive brushes or electroconductive leaf springs that slide on the power receiving portions 4*b* are used as the second power supply members, it is preferable that electroconductive grease be applied to prevent wear of the contact portions with the power receiving portions 4*b*.

Although the edge face of the shaft portion 20 serves as the power receiving portion 3*b* of the inner electrode 3*a*1, the power receiving portion is not limited thereto. For example, the power receiving portion 3*b* may be a circumferential surface of the shaft portions 20 or an edge face of the roller body.

(Variation 1)

A first variation of the power supply structure for the inner electrode 3*a* and the outer electrode 4*a* is described below.

Figure 21:
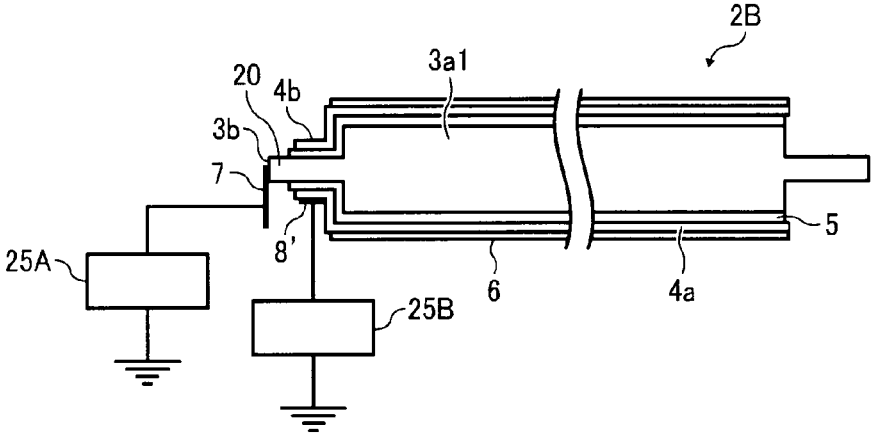
FIG. 21 is a schematic cross-sectional view of the toner-carrying roller along the axial direction and illustrates a power supply configuration according to a variation.
Figure 22:
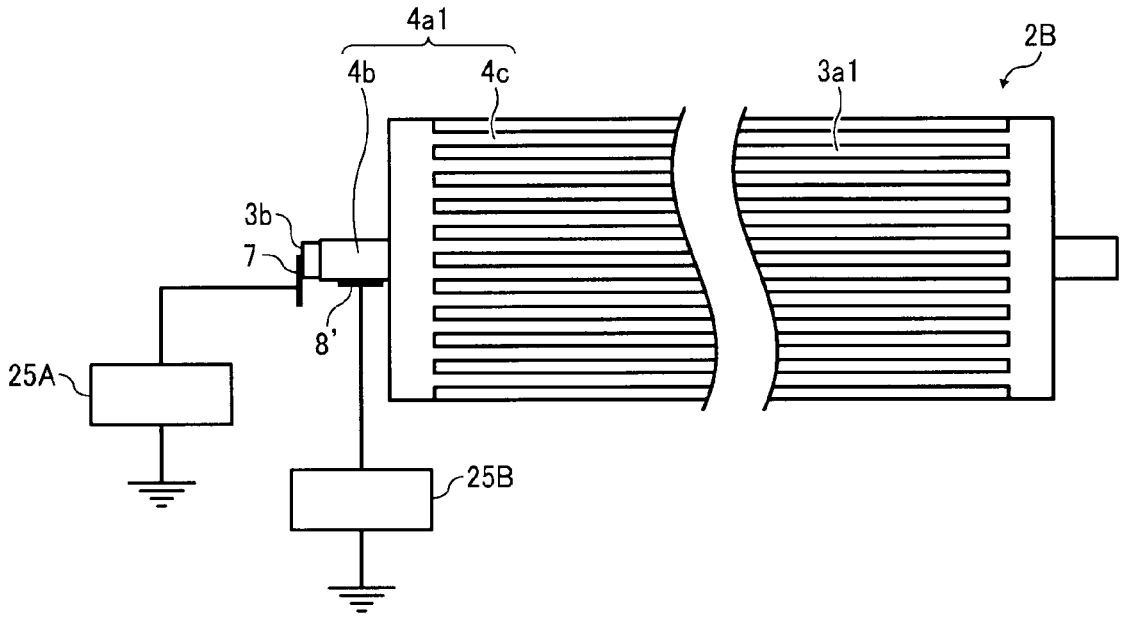
FIG. 22 is a schematic diagram of the toner-carrying roller together with the power supply structure shown in FIG. 21 as viewed in the direction perpendicular to the axial direction thereof.
Figure 23:
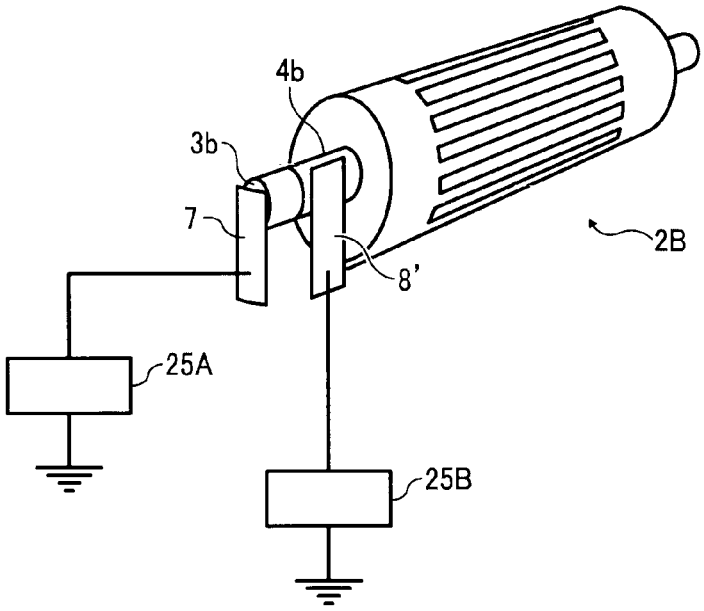
FIG. 23 is a schematic perspective view of the toner-carrying roller together with the power supply structure shown in FIG. 19.

FIG. 21 is a schematic cross-sectional view of a toner-carrying roller 2B along the axial direction together with a power supply structure to an inner electrode 3*a*1 and an outer electrode 4*a* thereof. FIG. 22 is a schematic diagram of the toner-carrying roller 2B together with the power supply structure shown in FIG. 21 as viewed in the direction perpendicular to the axial direction thereof. FIG. 23 is a schematic perspective view of the toner-carrying roller 2B together with the power supply structure shown in FIG. 19.

In the first variation, the structure of power supply to the inner electrode 3*a* is similar to that of the second embodiment shown in FIGS. 19 and 20, in which the inner electrode 3*a* is integrated with the shaft portion 20 and the power receiving portions 3*b* is an edge face of the shaft portion 20, with which the power supply brush 7 is in contact. A power receiving portion 4*b* of an outer electrode 4*a*1, however, is different from those shown in FIGS. 19 and 20. The outer electrode 4*a*1 extends to cover the circumference of shaft portion 20 of the toner-carrying roller 2B, and the extended portion (circumferential surface of the shaft portion 20) serves as the power receiving portion 4*b*. The insulation layer 5 extends to cover the shaft portion 20 as well to insulate the inner electrode 3*a* from the outer electrode 4*a* in the shaft portion 20. The power supply brush 8' connected to the power supply unit 25B is in contact with the power receiving portion 4*b* that is on the circumferential surface of the shaft portion 20.

In addition to the configuration of the first variation, the following power supply structure may be used. For example, the shaft portions on both sides of the toner-carrying roller 2A are electrically separated from each other, the inner electrode 3*a* and the outer electrode 4*a* are respectively made conductive with the shaft portions, and voltages are applied to the inner electrode 3*a* and outer electrode 4*a* via the shaft portions, respectively.

(Second Variation)

A variation of the structure to supply toner to the toner-carrying roller 2 is described below as a second variation.

Figure 24:
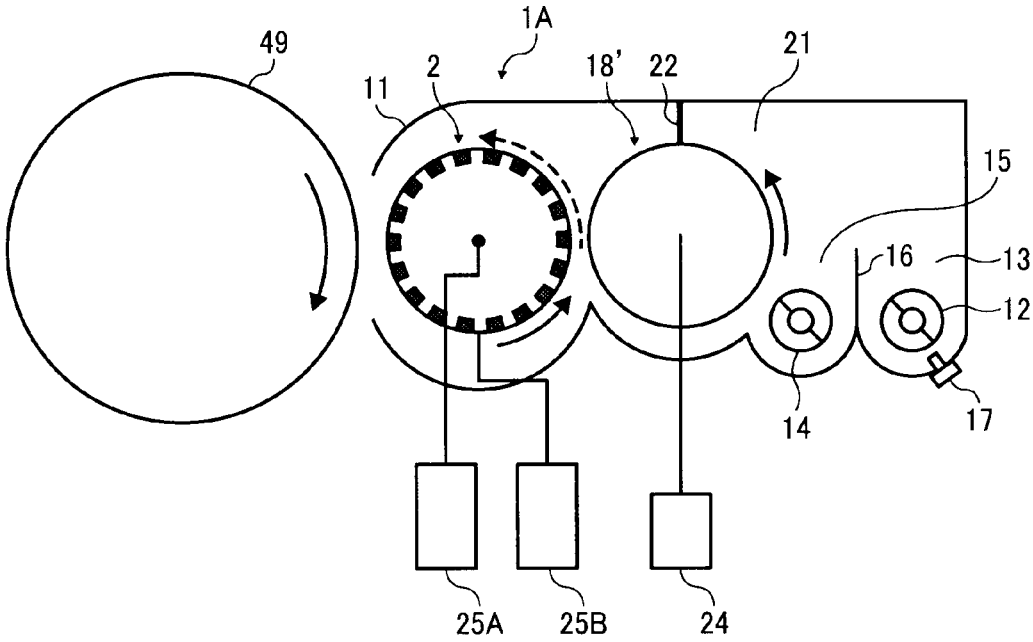
FIG. 24 is a schematic cross-sectional view of a development device according to a second variation together with the photoreceptor.

FIG. 24 is a schematic cross-sectional view of a development device 1A according to the second variation together with the photoreceptor 49.

In the second variation, magnetic carrier particles are not used to supply toner to the toner-carrying roller 2. More specifically, the development device 1A includes a casing 11 in which a first developer compartment 13, a second developer compartment 15, and a magnetic brush forming area 21 are formed. The development device 1A further includes a first conveyance screw 12 that is provided in the first developer compartment 13 and rotates clockwise in FIG. 24, and a second conveyance screw 14 that is provided in the developer compartment 15 and rotates counterclockwise in FIG. 24. The first and second developer compartments 13 and 15 are divided by a partition 16 at least partly. The first and second developer compartments 13 and 15 contain toner (toner particles) charged to have a negative polarity as developer. As the first conveyance screw 12 and the second conveyance screw 14 rotate, the toner is circulated in the first developer compartment 13 and the developer compartment 15. While being transported by the first conveyance screw 12 and the second conveyance screw 14, the toner is frictionally charged by sliding contact with them. The frictionally charged toner in the developer compartment 15 then electrostatically adheres to a toner supply roller 18' to which a supply bias is applied by the supply bias power source 24. It is to be noted that the supply bias can be a DC voltage, an alternating current AC voltage, or a DC voltage overlapped with AC voltage. After the developer regulator 22 adjusts the amount, the toner adsorbed to the toner supply roller 18' is transported to a supply position. At the supply position, the toner is supplied to the toner-carrying roller 2 with effects of the difference in electrical potential between the toner supply roller 18' and the toner-carrying roller 2. The subsequent processes are similar to those in the above-described first embodiment, and the descriptions thereof are omitted.

(Third Variation)

Another variation of the structure to supply toner to the toner-carrying roller 2 is described below as a third variation.

Figure 25:
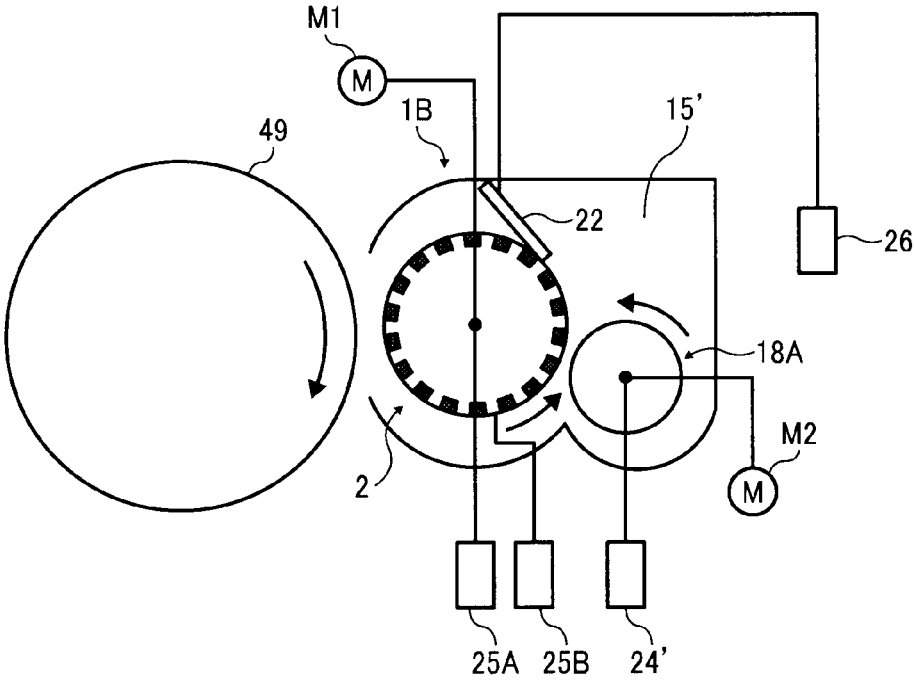
FIG. 25 is a schematic cross-sectional view of a development device according to a third variation together with the photoreceptor.

FIG. 25 is a schematic cross-sectional view of a development device 1B according to the third variation together with the photoreceptor 49. In the third variation, toner is supplied to the toner-carrying roller 2 without using magnetic carrier particles similarly to the above-described second variation. In addition, the development device 1B use a toner supply member having a porous surface in which many fine poles are distributed to supply toner directly to the toner-carrying roller 2.

More specifically, a toner supply roller 18A (e.g., a sponge roller) having a porous surface layer such as a sponge layer is provided in the toner containing compartment 15'. The toner supply roller 18A is disposed in direct contact with the surface of the toner-carrying roller 2. With this configuration, the toner that adheres to the sponge surface of the toner supply roller 18A in the toner containing compartment 15' is frictionally charged by sliding contact in the contact portion with the surface of the toner-carrying roller 2. Thus, the toner is supplied to the toner-carrying roller 2 electrostatically. Although the toner supply roller 18A rotates in the direction counter to the toner-carrying roller 2 in the configuration shown in FIG. 25, the toner supply roller 18A may rotate in the trailing direction.

In addition, the driving unit M2 rotates the toner supplying roller 18' such that the outer circumferential surface thereof moves at a velocity different from the velocity of movement of the circumferential surface of the toner-carrying roller 2 in a portion where the developer supplying roller 18' faces the toner-carrying roller 2.

In the third variation, the amount of toner supplied to the toner-carrying roller 2 can be adjusted with the supply bias applied by the supply bias power source 24' connected to the toner supply roller 18A. The supply bias can be a DC voltage, an alternating current AC voltage, or a DC voltage overlapped with AC voltage. Alternatively, a bias voltage having one of the above-described first through ninth voltage waveforms shown in FIGS. 10 through 18 may be used.

Additionally, in the configuration shown in FIG. 25, the developer regulator 22 is positioned facing the circumferential surface of the toner-carrying roller 2 to regulate the amount of toner supplied to the toner-carrying roller 2 from the toner supply roller 18A. The developer regulator 22 is disposed in contact with the surface of the toner-carrying roller 2 in an initial state and, during operation, toner enters between the developer regulator 22 and the toner-carrying roller 2. In this configuration, triboelectric charging of the toner is further promoted by sliding contact in the contact portion between the developer regulator 22 and the toner-carrying roller 2.

In view of the foregoing, a bias may be also applied to the developer regulator 22 from a power source 26 as required to reduce the electrical discharge. The bias applied to the developer regulator 22 can be a DC voltage, an alternating current AC voltage, or a DC voltage overlapped with AC voltage. Alternatively, a bias voltage having one of the above-described first through ninth voltage waveforms shown in FIGS. 10 through 18 may be used.

Further, the bias applied to the developer regulator 22 may have a potential equal or similar to a mean electrical potential of the cyclic bias voltage having any of the waveforms shown in FIGS. 10 through 18, applied to the inner electrode 3*a* or outer electrode 4*a*.

(Fourth Variation)

Next, as a variation, a development device including a toner collecting unit 30 is described below. The toner collecting unit 30 is for collecting toner that is not used in image development from the toner-carrying roller 2.

Figure 26:
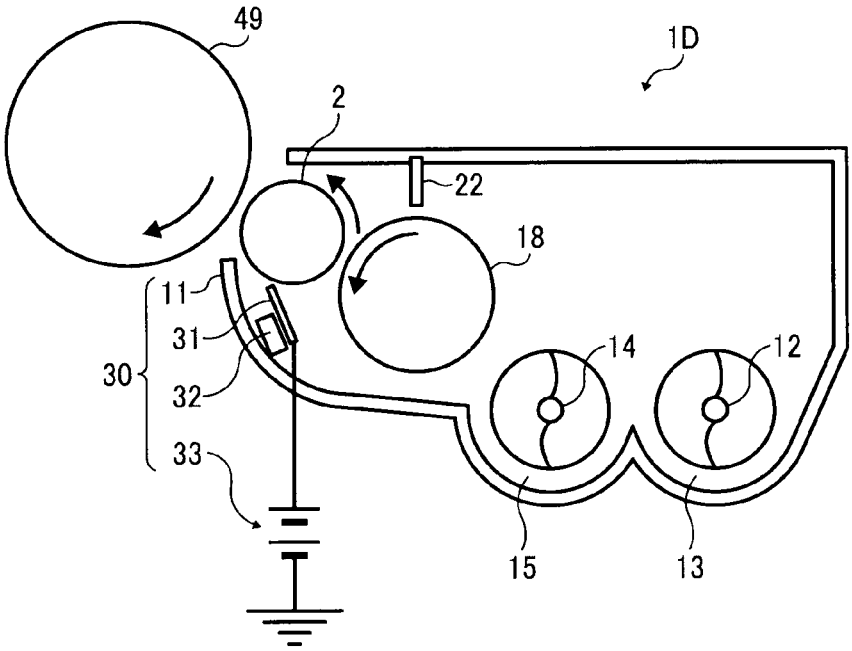
FIG. 26 is a schematic cross-sectional view of a development device according to a fourth variation together with the photoreceptor.

FIG. 26 is a schematic cross-sectional view of a development device 1D according to the third variation together with the photoreceptor 49.

The development device 1D in the fourth variation is different from the configuration in the above-described embodiment 1 in that a toner collecting unit 30 is provided and the shape of the inner face of the casing 11 is different in a portion below the toner-carrying roller 2 and the toner supply roller 18. That portion of the casing 11 is inclined toward the second developer compartment 15 containing the second conveyance screw 14. Except these, the configuration of the development device 1D is similar to that of the first embodiment.

The toner collecting unit 30 includes a collecting plate 31 disposed facing an outer circumferential surface of the toner-carrying roller 2, a vibrator 32 disposed to contact the collecting plate 31, and a power source 33 to apply a predetermined voltage to the collecting plate 31. Between the toner-carrying roller 2 and the collecting plate 31, an electrical field in the direction to move negatively charged toner electrostatically from the toner-carrying roller 2 to the collecting plate 31 is formed. Thus, in an area where the collecting plate 31 faces the toner-carrying roller 2 (a collection area), the toner that is not used in image development moves from the toner-carrying roller 2 to the collecting plate 31. The toner adhering to the collecting plate 31 is flung off from the collecting plate 31 as the vibrator 32 shakes the collecting plate 31. The fallen toner then moves on the inner face of the casing 11 to the second developer compartment 15. Then, the toner is again circulated in the first developer compartment 13 and the second developer compartment 15.

Figure 27:
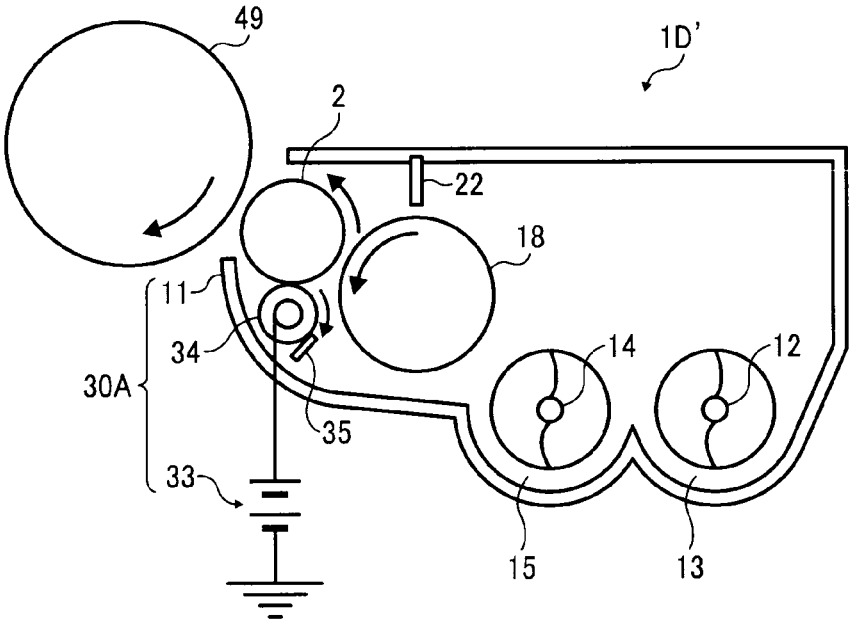
FIG. 27 is a schematic cross-sectional view of another configuration of the development device according to the fourth variation together with the photoreceptor.

FIG. 27 illustrates another configuration of the toner collecting unit.

A development device 1D' shown in FIG. 27 includes a toner collecting unit 30A that employs a collecting roller 34. The toner collecting unit 30A includes the collecting roller 34 disposed facing an outer circumferential surface of the toner-carrying roller 2, a cleaning blade 35 disposed to contact the collecting roller 34, and a power source 33 to apply a predetermined voltage to the collecting roller 34. Between the toner-carrying roller 2 and the collecting roller 34, an electrical field in the direction to move negatively charged toner electrostatically from the toner-carrying roller 2 to the collecting roller 34 is formed. Thus, in the collection area where the collecting roller 34 faces the toner-carrying roller 2, the toner that is not used in image development moves from the toner-carrying roller 2 to the collecting roller 34. The cleaning blade 35 scrapes off the toner adhering to the collecting roller 34. The fallen toner then moves on the inner face of the casing 11 to the second developer compartment 15. Then, the toner is again circulated in the first developer compartment 13 and the second developer compartment 15.

Third Embodiment

Figure 28:
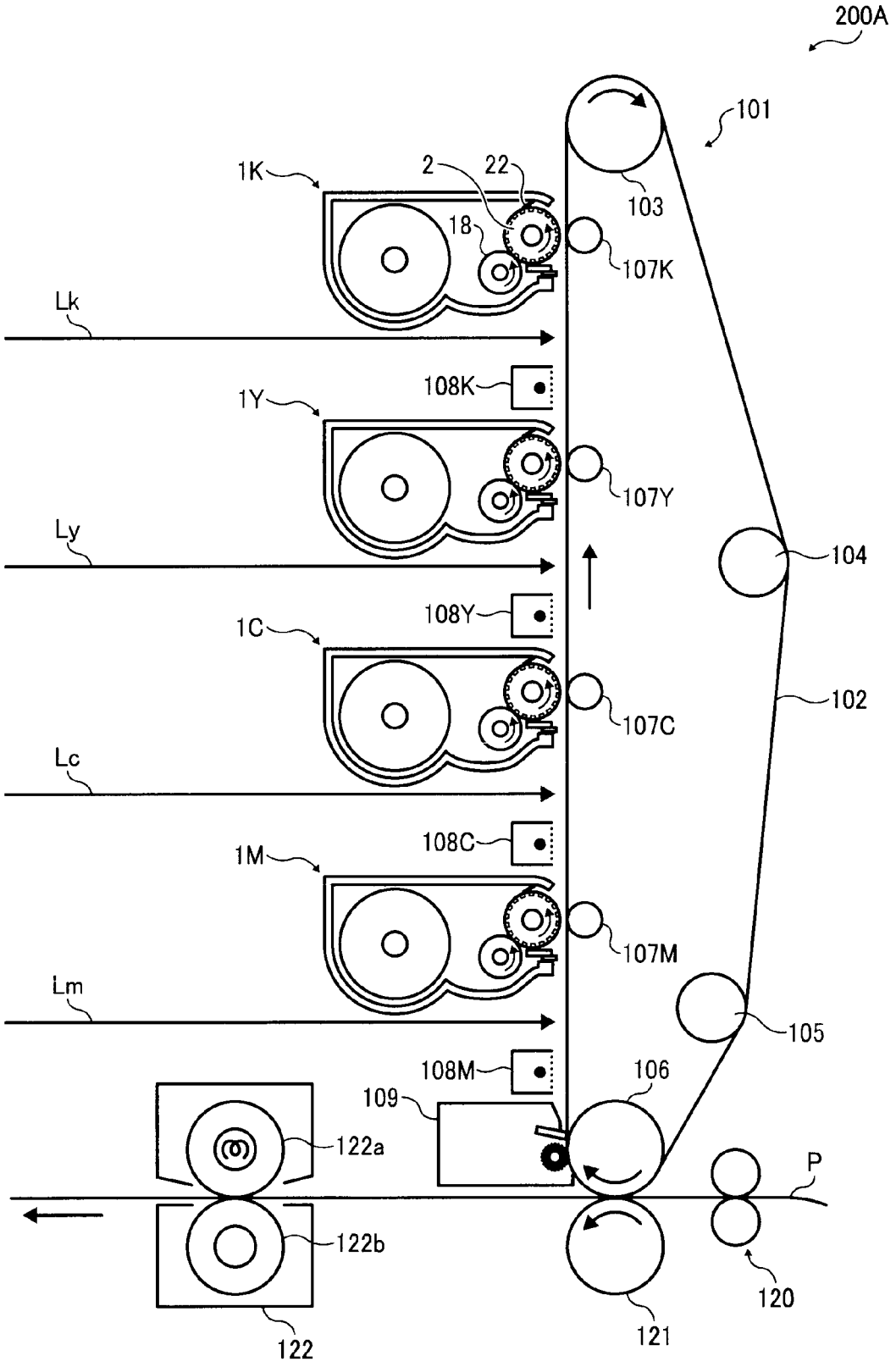
FIG. 28 is a schematic view illustrating a configuration of an image forming apparatus according to another embodiment.

FIG. 28 is a schematic view illustrating a configuration of an image forming apparatus 200A according to another embodiment. The image forming apparatus 200A shown in FIG. 28 includes multiple development devices, and multiple single-color images are superimposed one on another on an endless belt-shaped photoreceptor (photoreceptor belt 102) serving as a latent image bearer.

The image forming apparatus 200A is capable of multicolor image formation by superimposing magenta (M), cyan (C), yellow (Y), and black (K) toner images one on another. The image forming apparatus 200A includes a belt unit 101, four development devices 1M, 1C, 1Y, and 1K, a pair of registration rollers 120, a transfer roller 121, and a fixing device 122. Although not shown, the image forming apparatus further includes a sheet cassette, a sheet feeder, and a paper feeding path.

The four development devices 1M, 1C, 1Y, and 1K have a similar configuration and include a toner-carrying roller 2 serving as a developer carrier, a toner supply roller 18, and a developer regulator 22 housed in a casing. Although the development device 1M, 1C, 1Y, and 1K are simplified in FIG. 28, configurations and operations thereof are similar to those in the above-described first and second embodiments and the variations.

In the belt unit 101, the photoreceptor belt 102 is stretched around multiple rollers into a loop that is longer in the vertical direction and rotates clockwise in FIG. 28. More specifically, the photoreceptor belt 102 is supported from the back side by a driving roller 103, a tension roller 104, a support roller 105, a backup roller 106, and four facing rollers 107M, 107C, 107Y, and 107K disposed facing the toner-carrying rollers 2. As the driving roller 103 rotates clockwise in FIG. 28, driven by a driving unit, the photoreceptor belt 102 rotates endlessly. The left side of the loop of the photoreceptor belt 102 in FIG. 28 extends substantially vertically.

The development devices 1M, 1C, 1Y, and 1K are arranged vertically on the left of the photoreceptor belt 102, facing the vertically extending portion of the photoreceptor belt 102 on the left.

Additionally, charging devices 108, 108C, 108Y, and 108K are disposed beneath the respective development devices 1M, 1C, 1Y, and 1K and face the vertically extending portion of the photoreceptor belt 102 on the left.

Further, although not shown, an optical writing device is provided on the left of the development devices 1M, 1C, 1Y, and 1K. The optical writing device drives four semiconductor lasers to emit writing beams Lm, Lc, Ly, and Lk according to image data transmitted from computers or scanners. The writing beams Lm, Lc, Ly, and Lk are directed to the photoreceptor belt 102 via reflecting mirrors and an optical lens while being deflected by a polygon mirror. Thus, optical scanning on the surface of the photoreceptor belt 102 is performed. Alternatively, light-emitting diode (LED) arrays may be used. The optical scanning is performed in the dark.

The photoreceptor belt 102 moves vertically upward in a portion between the backup roller 106, which is positioned lowest among the rollers supporting the photoreceptor belt 102, and the driving roller 103, which is positioned highest among the support rollers. Then, after passing by the driving roller 103, the photoreceptor belt 102 moves downward. The photoreceptor belt 102 is charged uniformly, for example, to a negative polarity at a portion facing the charging device 108M. After an electrostatic latent image for magenta is formed by the writing beam Lm, the photoreceptor belt 102 passes through a portion facing the development device 1M. Then, the development device 1M develops the electrostatic latent image formed on the photoreceptor belt 102 into a magenta toner image. Subsequently, a discharger discharges the photoreceptor drum 102 in preparation to subsequent image formation.

Further, while moving upward, the photoreceptor belt 102 is charged uniformly by the charging device 108C, after which an electrostatic latent image for cyan is formed by the writing beam Lc. Then, the development device 1C develops the electrostatic latent image formed on the photoreceptor belt 102 into a cyan toner image. At that time, the cyan toner image overlies partly or entirely the magenta image formed on the photoreceptor belt 102 in advance. The superimposed portion becomes bichrome with magenta and cyan toners. Subsequently, a discharger discharges the photoreceptor belt 102 in preparation to subsequent image formation.

Further, while moving upward, the photoreceptor belt 102 is charged uniformly by the charging device 108Y, after which an electrostatic latent image for yellow is formed by the writing beam Ly. Then, the development device 1Y develops the electrostatic latent image formed on the photoreceptor belt 102 into a yellow toner image. At that time, the yellow toner image overlies partly or entirely the magenta and cyan images formed on the photoreceptor belt 102 in advance. The superimposed portion becomes bichrome with two of magenta, cyan, and yellow toners or trichromatic with magenta, cyan, and yellow toners. Subsequently, a discharger discharges the photoreceptor belt 102 in preparation to subsequent image formation.

Further, while moving upward, the photoreceptor belt 102 is charged uniformly by the charging device 108K, after which an electrostatic latent image for black is formed by the writing beam Lk. Then, the development device 1K develops the electrostatic latent image formed on the photoreceptor belt 102 into a black toner image. Thus, four color images are superimposed one on another, forming a multicolor image, on the front side (outer side of the loop) of the photoreceptor belt 102.

The transfer roller 121 is pressed against the front side of a portion of the photoreceptor belt 102 winding around the backup roller 106, thus forming a transfer nip therebetween. Whereas the backup roller 106 is grounded, the conductive transfer roller 121 receives a transfer bias from a bias application unit. With this configuration, a transfer electrical field is generated between the backup roller 106 and the transfer roller 121, forming the transfer nip, to move the toner electrostatically from the photoreceptor belt 102 toward the transfer roller 121.

Meanwhile, the sheet feeder sends out a recording sheet (recording medium) P from the sheet cassette at a predetermined timing. The sheet P is transported through the paper feeding path and gets stuck in the nip between the registration rollers 120 on the right in FIG. 28. Immediately after clamping a leading edge portion of the recording sheet P therebetween, the registration rollers 120 stop rotating temporarily and resume rotating to forward the recording sheet to the transfer nip, timed to coincide with the superimposed toner image on the photoreceptor belt 102.

In the transfer nip, the superimposed toner image is transferred at a time from the photoreceptor belt 102 onto the recording sheet P with the nip pressure and the effects of the transfer electrical field. The image becomes a full-color (multicolor) image on the white recording sheet P.

Subsequently, the recording sheet P carrying the multicolor toner image is transported to the fixing device 122. For example, the fixing device 122 includes a fixing roller 122*a* inside which a heat source such as a halogen lamp or a heater is provided, and a pressure roller 122*b* pressed against the fixing roller 122*a*, thus forming a fixing nip therebetween. The recording sheet P is clamped in the fixing nip. Subsequently, the toner image is fixed on the recording sheet P with heat from the fixing roller 122*a* and pressure in the fixing nip.

Then, the recording sheet P is discharged by a pair of discharge rollers outside the image forming apparatus 200A. It is to be noted that a cleaning unit 109 removes any toner remaining on the surface of the photoreceptor belt 102 that has passed through the transfer nip.

In the third embodiment, because four different color images are written and formed on a single photoreceptor belt 102, positional deviation rarely occurs theoretically. Therefore, high-quality multicolor images can be produced. In addition, in development system using the development devices according to the above-described first and second embodiments and the variations, the toner-carrying roller 2 does not contact the photoreceptor belt 102 and AC electrical fields are not present in the development range. Therefore, development process of subsequent colors do not affect toner images formed on the photoreceptor mechanically or electrically, thus eliminating inconveniences such as scavenging or color mixing. Thus, reliable image forming processes can be repeated long time, producing high-quality images.

Fourth Embodiment

An image forming apparatus according to a fourth embodiment is described below.

Figure 29:
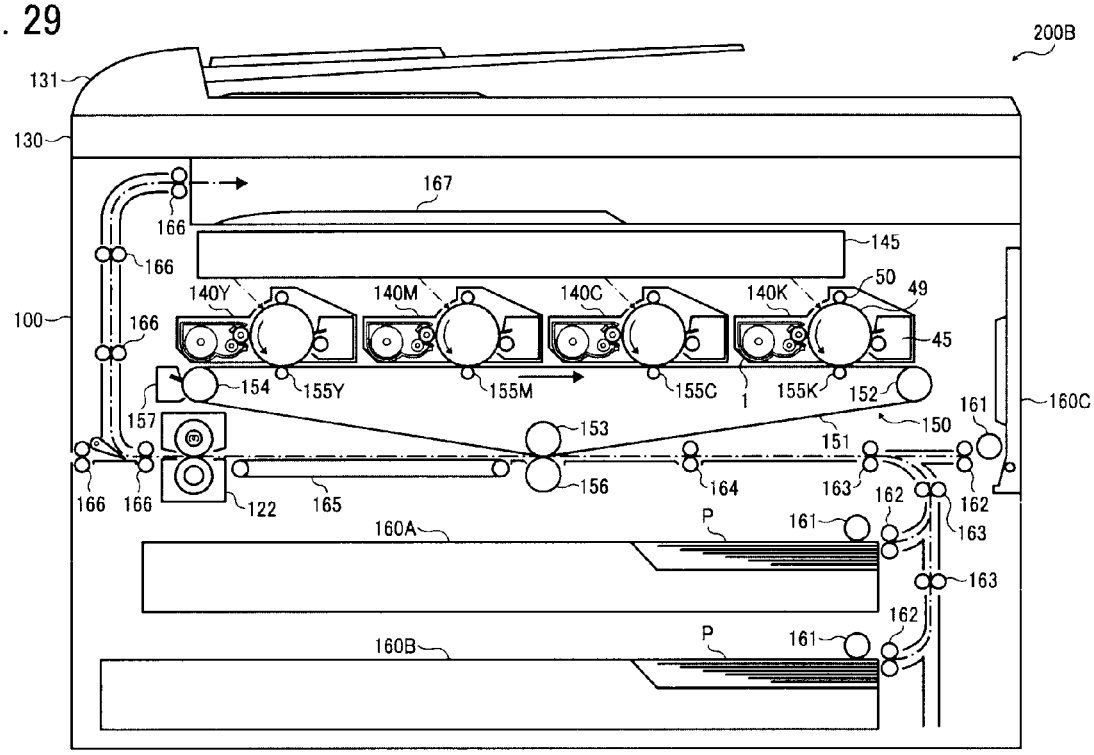
FIG. 29 is a schematic view illustrating a configuration of an image forming apparatus according to yet another embodiment.

FIG. 29 illustrates an image forming apparatus 200B that includes multiple process cartridges 140 and capable of monochrome image formation and multicolor image formation.

The multicolor image forming apparatus 200B includes an image forming unit (printer unit) 100, an image reading unit (scanner) 130, and a automatic document feeder (ADF) 131 and has capabilities of digital copying, printing, facsimile transmission. The image forming unit 100 forms images according to image data of original documents read by the image reading unit 130 or image data transmitted from computers via LAN or communication lines.

The process cartridges 140Y, 140M, 140C, and 140K each include a drum-shaped photoreceptor 49 serving an a latent image bearer, a changing unit 50, and a development device 1 housed in a common unit casing.

When an optical writing device, a transfer device, a fixing device, a sheet feeder, and the like are added to the process cartridge 140, a single-color image forming apparatus can be formed.

The process cartridges 140 are removably installable to the image forming apparatus 200B, facilitating replacement and recycling. Thus, maintenance of the image forming apparatus 200B can be easier, and resources can be saved.

A transfer unit 150 is provided in a center portion of the image forming unit 100. The transfer unit 150 includes an intermediate transfer belt 151, primary-transfer rollers 155Y, 155M, 155C, and 155K, and a secondary-transfer roller 156. The intermediate transfer belt 151 is stretched around a driving roller 152, a driven roller 154, and a facing roller 153 disposed facing the secondary-transfer roller 156. The four process cartridges 140Y, 140M, 140C, and 140K having a similar configuration are arranged in parallel on an upper side of the intermediate transfer belt 151. The process cartridge 140Y forms a yellow toner image on the photoreceptor 49 through electrophotographic method including charging by the charging device 50, optical writing by an optical writing device 145, and image development by the development device 1. Similarly, the process cartridges 140M, 140C, and 140K forms magenta, cyan, and black toner images on the respective photoreceptors 49. The single-color toner images formed on the photoreceptors 49 of the process cartridges 140Y, 140M, 140C, and 140K are sequentially transferred by the primary-transfer rollers 155Y, 155M, 155C, and 155K, respectively, and superimposed one on another on the intermediate transfer belt 151.

Multiple sheet cassettes 160A and 160B containing recording sheets P are provided beneath the transfer device 150. The recording sheets P are transported from either the sheet cassette 160A or 160B (or manual insertion tray 160C provided on a side of the apparatus), timed to coincide with image formation in the process cartridges 140Y, 140M, 140C, and 140K. The recording sheets P are separated one by one by a feed roller 161 and a separation roller 162 and transported by multiple conveyance rollers 163 to a pair of registration rollers 164. The registration rollers 164 forward the recording sheet P to a secondary-transfer position, timed to coincide with arrival of the superimposed toner image on the intermediate transfer belt 151 to the secondary-transfer roller 156. The secondary-transfer roller 156 transfers the superimposed toner image from the intermediate transfer belt 151 onto the recording sheet P at a time. Subsequently, a transport belt 165 transports the recording sheet P to the fixing device 122, and the fixing device 122 fixes the image on the recording sheet P with heat and pressure. The recording sheet P is then transported by multiple rollers 166 to a discharge tray 167 or an external device such as post-processing apparatus. Additionally, the cleaning unit 45 removes any toner remaining on the photoreceptor 49 in each process cartridge 140. Further, a belt cleaning unit 157 removes toner remaining on the intermediate transfer belt 151 after the toner image is transferred therefrom.

In the image forming apparatus 200B, single color or multicolor images can be produced by selectively driving the process cartridges 140Y, 140M, 140C, and 140K. The process cartridges 140Y, 140M, 140C, and 140K are removably installable to the image forming apparatus 200B, facilitating replacement and recycling. Thus, maintenance of the image forming apparatus 200B can be easier, and resources can be saved.

It is to be noted that, although FIG. 29 illustrates the tandem-type multicolor image forming apparatus including four process cartridges 140Y, 140M, 140C, and 140K arranged in parallel along the intermediate transfer belt 151, the features of the above-described embodiments can adapt to tandem-type multicolor image forming apparatuses employing direct-transfer methods. In such a case, instead of the intermediate transfer belt 151, toner images are transferred directly from the photoreceptors of the respective process cartridges onto recording sheets transported by a transport belt.

As described above, in the embodiments of the present invention, toner flare is created on or around the insulative surface of the developer carrier, and the counter charge on the surface of the developer carrier is removed by electrical discharge. The voltages applied to the electrodes of the developer carrier in the present embodiment have such waveforms to reduce abrasion of the surface layer, thereby reducing changes in the development field over time resulting from it.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device for causing a developer to adhere to an electrostatic latent image formed on a latent image bearer, the development device comprising:

a developer container for containing the developer;

a rotary cylindrical developer carrier disposed in the developer container, facing the latent image bearer, the developer carrier including:

an outer electrode including multiple electrode portions arranged in a circumferential direction of the developer carrier, an inner electrode provided on an inner circumferential side of the developer carrier from the outer electrode and electrically insulated from the outer electrode, an insulation layer disposed between the outer electrode and the inner electrode, and a surface layer provided on an outer side of the outer electrode; and a first bias power source to apply a first bias voltage and a second bias voltage to the inner electrode and the outer electrode, respectively, the first bias power source causing an electrical potential difference that changes with time between the inner electrode and the outer electrode to cause the developer to hop on a circumferential surface of the developer carrier, wherein at least one of the first bias voltage and the second bias voltage has a cyclic waveform having a predetermined frequency, wherein pulse-on time in a single cycle of the cyclic waveform is 50% of the single cycle or less, and wherein either a rising edge or a trailing edge of the pulse-on time of each of the outer electrode and the inner electrode is adjusted to set an electrical potential difference between the outer electrode and the inner electrode to Vpp/2, wherein Vpp is defined as a peak-to-peak voltage.

2. The development device according to claim 1, wherein a rise time of at least one of the first bias voltage and the second bias voltage is greater than a predetermined rise time of the voltage applied.

3. The development device according to claim 1, wherein a frequency of at least one of the first bias voltage and the second bias voltage is less than a predetermined frequency of the voltage applied.

4. The development device according to claim 1, wherein the developer carrier is shaped like a roller, and the multiple electrode portions of the outer electrode are shaped like teeth of a comb arranged at similar intervals in the circumferential direction of the developer carrier.

5. The development device according to claim 1, further comprising:

a developer supplying member to supply the developer to the developer carrier; and a second bias power source to apply a third bias voltage to the developer supplying member, the third bias voltage having a cyclic waveform having a predetermined frequency, wherein pulse-on time in a single cycle of the cyclic waveform is 50% of the single cycle or less.

6. The development device according to claim 5, wherein the developer supplying member is a roller having a porous surface in which many fine pores are distributed.

7. The development device according to claim 5, further comprising a driving unit to rotate the developer supplying member such that an outer circumferential surface of the developer supplying member moves at a velocity different from a velocity at which the circumferential surface of the developer carrier rotates in a portion where the developer supplying member faces the developer carrier.

8. The development device according to claim 1, further comprising:

a developer regulator disposed facing the circumferential surface of the developer carrier to adjust an amount of the developer carried on the developer carrier; and a third bias power source to apply a fourth bias voltage to the developer regulator, the fourth bias voltage having a cyclic waveform having a predetermined frequency, wherein pulse-on time in a single cycle of the cyclic waveform is 50% of the single cycle or less.

9. The development device according to claim 8, wherein the developer regulator is electroconductive.

10. The development device according to claim 8, wherein the fourth bias voltage applied to the developer regulator is similar to a mean electrical potential of the first bias voltage or the second bias voltage that has the cyclic waveform.

11. The development device according to claim 1, wherein the surface layer is constructed of an electrically insulative material to give an electrical charge of a normal charge polarity to the developer through sliding contact between the surface layer and the developer.

12. The development device according to claim 1, wherein the developer is a toner that is colored and powdered.

13. A process cartridge process cartridge removably installable in an image forming apparatus, comprising the development device according to claim 1, wherein the development device and at least one of the latent image carrier, a charging device, and a cleaning device are housed in a common casing.

14. An image forming apparatus comprising:

a latent image bearer on which a latent image is formed;

a charging device to charge a surface of the latent image bearer;

a cleaning device to clean the surface of the latent image bearer;

a development device for causing a developer to adhere to an electrostatic latent image formed on the latent image bearer; and a transfer unit to transfer a toner image from the latent image bearer onto a sheet of recording media, wherein the development device includes:

a developer container for containing the developer, a rotary cylindrical developer carrier disposed in the developer container, facing the latent image bearer, the developer carrier including an outer electrode including multiple electrode portions arranged in a circumferential direction of the developer carrier, an inner electrode provided on an inner circumferential side of the developer carrier from the outer electrode and electrically insulated from the outer electrode, an insulation layer disposed between the outer electrode and the inner electrode, and a surface layer provided on an outer side of the outer electrode, and a first bias power source to apply a first bias voltage and a second bias voltage to the inner electrode and the outer electrode, respectively, the first bias power source causing an electrical potential difference that changes with time between the inner electrode and the outer electrode to cause the developer to hop on a circumferential surface of the developer carrier, wherein at least one of the first bias voltage and the second bias voltage has a cyclic waveform having a predetermined frequency, wherein pulse-on time in a single cycle of the cyclic waveform is 50% of the single cycle or less, and wherein either a rising edge or a trailing edge of the pulse-on time of each of the outer electrode and the inner electrode is adjusted to set an electrical potential difference between the outer electrode and the inner electrode to Vpp/2, wherein Vpp is defined as a peak-to-peak voltage.

15. The image forming apparatus according to claim 14, wherein the development device and at least one of the latent image carrier, the charge device, and the cleaning device are housed in a common casing and integrated as a process cartridge removably installable to the image forming apparatus.

16. The image forming apparatus according to claim 15, further comprising at least one additional process cartridge in which a development device and at least one of a latent image carrier, a charging device, and a cleaning device are housed in a common casing, wherein multiple different color toner images are formed on the respective latent image bearers, and the multiple toner images are transferred from the respective latent image bearers and superimposed one on another on the sheet directly or via an intermediate transfer member.

17. The image forming apparatus according to claim 14, further comprising at least one additional development device, wherein the multiple development devices are arranged in parallel to each other in a direction in which the latent image bearer moves, and multiple latent images are formed one on another on the latent image bearer, and the multiple development devices sequentially develop the respective latent images into different color toner images, forming a superimposed multicolor toner image on the latent image bearer.

18. The development device according to claim 1, wherein at least one of the first bias voltage and the second bias voltage is an applied DC voltage.

19. The development device according to claim 1, wherein the pulse-on time is from 20% to 50% in the single cycle.

* * * * *